United States Patent [19]

Ohno et al.

[11] Patent Number: 4,977,051

[45] Date of Patent: Dec. 11, 1990

[54] TRISAZO ELECTROPHOTOGRAPHIC PHOTORECEPTOR

[75] Inventors: Shigeru Ohno; Katsuji Kitatani; Naonori Makino; Satoshi Hoshi; Hideo Sato, all of Kanagawa, Japan

[73] Assignee: Fuji Photo Film Co., Ltd., Kanagawa, Japan

[21] Appl. No.: 433,247

[22] Filed: Nov. 8, 1989

[30] Foreign Application Priority Data

Nov. 8, 1988 [JP] Japan ..... 63-281848

[51] Int. Cl.[5] ..... G03G 5/047; G03G 5/06

[52] U.S. Cl. ..... 430/58; 430/59; 430/70; 430/72; 430/75; 430/76; 430/77; 430/78; 534/653; 534/751; 534/752; 534/809

[58] Field of Search ..... 430/58, 59, 70, 72, 430/75, 76, 77, 78

[56] References Cited

U.S. PATENT DOCUMENTS

| | | | |
|---|---|---|---|
| 4,426,432 | 1/1984 | Sawada et al. | 430/58 |
| 4,433,039 | 2/1984 | Miyakawa et al. | 430/58 |
| 4,436,800 | 3/1984 | Ohta et al. | 430/59 |
| 4,504,559 | 3/1985 | Makino et al. | 430/76 X |
| 4,562,131 | 12/1985 | Sasaki et al. | 430/58 |
| 4,687,721 | 8/1987 | Emoto et al. | 430/58 |
| 4,731,315 | 3/1988 | Horie et al. | 430/58 X |
| 4,895,781 | 1/1990 | Tarcai | 430/58 |

FOREIGN PATENT DOCUMENTS

| | | | |
|---|---|---|---|
| 1-180556 | 7/1989 | Japan | 430/72 |

*Primary Examiner*—Roland E. Martin

*Attorney, Agent, or Firm*—Sughrue, Mion, Zinn, Macpeak & Seas

[57] ABSTRACT

An electrophotographic photoreceptor is disclosed, which comprises an electrically conductive support having thereon a layer which contains a charge carrier transporting compound and a charge carrier generating compound, or a layer which contains charge carrier transporting compound and a layer which contains a charge generating compound, wherein at least one type of tris-azo compound represented by formula (I) is included as a charge carrier generating compound:

(I)

wherein $Ar_1$, $Ar_2$, $Ar_3$, $Ar_4$ and A are as defined in the specification.

17 Claims, No Drawings

TRISAZO ELECTROPHOTOGRAPHIC PHOTORECEPTOR

FIELD OF THE INVENTION

The present invention concerns electrophotographic photoreceptors which are distinguished by having an electrophotographic photosensitive layer which contains one or more novel tris-azo compounds.

BACKGROUND OF THE INVENTION

Inorganic substances such as selenium, cadmium sulfide, zinc oxide and amorphous silicon are well known as photoconductive compositions which can be used in electrophotographic photoreceptors.

These inorganic photoreceptors are distinguished by having good electrophotographic properties, which is to say by providing very good photoconductivity and charge accepting properties, and insulating properties in the dark. However, they also have various disadvantages. For example, selenium photoreceptors are expensive to manufacture, they lack flexibility and are easily damaged by heat or mechanical shock. Cadmium sulfide photoreceptors give rise to problems with pollution because of the toxic material cadmium which is used in them. Zinc oxide has the disadvantage of being unable to provide image stability when used repeatedly over long periods of time. Moreover amorphous silicon photoreceptors are very expensive to manufacture and require special surface treatments to prevent deterioration of the photoreceptor surface.

Electrophotographic photoreceptors in which various organic substances are used have been proposed in recent years, and these have been used in practice. For example, there are electrophotographic photoreceptors comprised of poly-N-vinyl-carbazole and 2,4,7-trinitrofluoren-9-one (U.S. Pat. No. 3,484,237), electrophotographic photoreceptors in which poly-N-vinylcarbazole is sensitized with pyrylium based dyes (JP-B-48-25658), and electrophotographic photoreceptors in which co-crystalline complexes comprised of dyes and resins form the principal components (JP-A-47-10735). (The terms "JP-A" and "JP-B" as used herein signify an "unexamined published Japanese patent application" and an "examined Japanese patent publication" respectively.)

Furthermore, electrophotographic photoreceptors in which organic pigments such as perylene pigments (for example, U.S. Pat. No. 3,371,884), phthalocyanine pigments (for example, U.S. Pat. Nos. 3,397,086, 4,666,802), azulenium salt based pigments (for example, JP-A-59-53850, JP-A-61-212542), squalium salt based pigments (for example, U.S. Pat. Nos. 4,396,610, 4,644,082) and polycyclic quinone based pigments (for example, JP-A-59-184348, JP-A-62-28738), and azo pigments such as those indicated below form the principal component have been actively researched, and a great many such materials have been suggested.

Bis-azo Based Pigments

JP-A-47-37543, JP-B-60-5941, JP-B-60-45664, JP-A-56-116039, JP-A-58-123541, JP-A-61-260250, JP-A-61-228453, JP-A-61-275849 and JP-A-61-275850.

Tris-azo Based Pigments

U.S. Pat. Nos. 4,436,800 and 4,439,506, JP-A-53-132347, JP-A-55-69184, JP-A-57-195767, JP-A-57-200045, JP-A-57-204556, JP-A-58-31340, JP-A-58-31341, JP-A-58-154560, JP-A-58-160358, JP-A-58-160359, JP-A-59-127044, JP-A-59-196366, JP-A-59-204046, JP-A-59-204841, JP-A-59-218454, JP-A-60-111249, JP-60-111250, JP-A-61-11754, JP-A-61-22346, JP-A-61-35451, JP-A-61-67865, JP-A-61-121059, JP-A-61-163969, JP-A-61-179746, JP-A-61-230157, JP-A-61-251862, JP-A-61-251865, JP-A-61-269164, JP-A-62-21157, JP-A-62-78563 and JP-A-62-115452.

Tetrakis-azo Based Pigments

U.S. Pat. No. 4,447,513, JP-A-60-108857, JP-A-60-108858, JP-A/60-111247, JP-A-60-111248, JP-A-60-118843, JP-A-60-176046, JP-A-61-103157, JP-A-61-117559, JP-A-61-182051, JP-A-61-194447, JP-A-61-196253, JP-A-61-212848, JP-A-61-240246, JP-A-61-273548, JP-A-61-284769, JP-A-62-18565, JP-A-62-18566, and JP-A-62-19875.

These organic electrophotographic photoreceptors provide some degree of improvement in terms of mechanical properties and flexibility over the aforementioned inorganic electrophotographic photoreceptors, but they have low photosensitivity and in some cases they are unsuitable for high levels of repeated use, and they do not always satisfy the requirements of electrophotographic photoreceptor satisfactorily.

SUMMARY OF THE INVENTION

The aim of the present invention is to provide novel electrophotographic photoreceptors which have a high sensitivity and durability. A second aim of the invention is to provide novel electrophotographic photoreceptors with which there is little loss of photosensitivity even on repeated use.

This invention provides electrophotographic photoreceptors comprising an electrically conductive support having thereon a layer which contains a charge carrier transporting compound and a charge carrier generating compound, or a layer which contains a charge carrier transporting compound and a layer which contains a charge generating compound, wherein at least one type of tris-azo compound which can be represented by the general formula (I) indicated below is included as a charge carrier generating compound.

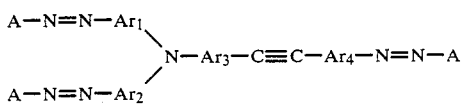

(I)

In this formula, $Ar_1$, $Ar_2$, $Ar_3$, and $Ar_4$, which may be the same or different, each represents a divalent condensed polycyclic aromatic group or a divalent heterocyclic aromatic group, and these groups may be further substituted with substituent groups. $Ar_1$ and $Ar_2$, $Ar_2$ and $Ar_3$, and $Ar_3$ and $Ar_1$ may, together with the nitrogen atom in general formula (I) and a group of other atoms as required, form rings.

A represents one of the following groups.

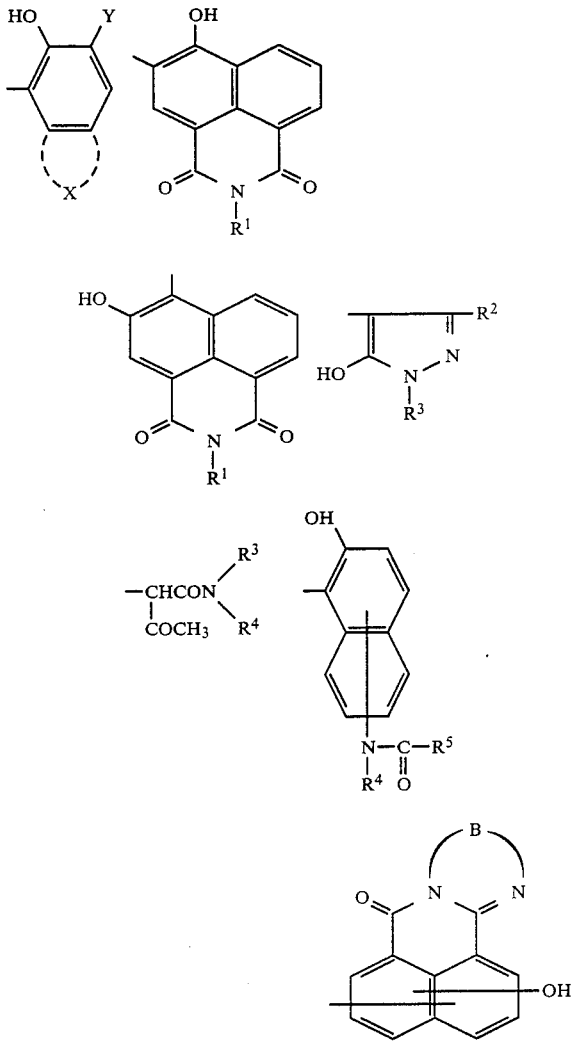

X represents a group of atoms which is required to form an aromatic ring or a heterocyclic ring which is condensed with the benzene ring to which the hydroxyl group and the group Y are bonded in the above mentioned formula, and these rings may be further substituted with substituent groups.

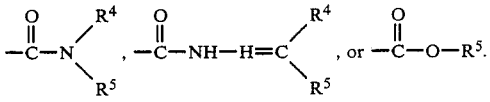

$R^1$ represents an alkyl group or a phenyl group, and these groups may be further substituted with substituent groups.

$R^2$ represents a hydrogen atom, lower alkyl group, carbamoyl group, carboxyl group, alkoxycarbonyl group, aryloxycarbonyl group or an amino group, and the amino group may be further substituted with substituent groups.

$R^3$ represents an alkyl group, an aromatic group or a heterocyclic aromatic group, and these groups may be further substituted with substituent groups.

$R^4$ and $R^5$ represent hydrogen atoms, alkyl groups, aromatic groups or heterocyclic aromatic groups, and the alkyl groups, aromatic groups and heterocyclic aromatic groups may be further substituted with substituent groups.

However, $R^4$ and $R^5$ cannot both be hydrogen atoms at the same time.

Furthermore, $R^5$ may not be a hydrogen atom when Y

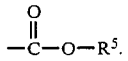

B represents a divalent aromatic hydrocarbyl group or a divalent heterocyclic ring in which a nitrogen is included, and these groups may be further substituted with substituent groups.

DETAILED DESCRIPTION OF THE INVENTION

The tris-azo compounds represented by general formula (I) are described in detail below.

X is a group which can be condensed with a benzene ring to which a hydroxyl group and a Y group are bonded to form an aromatic system, such as a naphthalene ring or an anthracene ring, or a heterocyclic system, such as an indole ring, carbazole ring, benzocarbazole ring or a dibenzofuran ring.

When X represents a substituted aromatic or heterocyclic system, the substituent groups may be halogen atoms (for example, fluorine, chlorine, or bromine) or lower alkyl groups, and preferably lower alkyl groups which have from 1 to 8 carbon atoms (for example, methyl, ethyl, propyl, butyl, iso-propyl, iso-butyl), and there may be one or two substituent groups. In those cases where there are two substituent groups the groups may be the same or different.

$R^1$ is an alkyl group, preferably an alkyl group which has from 1 to 12 carbon atoms, or a phenyl group.

Examples of unsubstituted alkyl groups which may be represented by $R^1$ include methyl, ethyl, propyl, butyl, pentyl, hexyl, iso-propyl, iso-butyl, iso-amyl, iso-hexyl, neo-pentyl and tert-butyl.

Examples of substituent groups in those cases where $R^1$ represents a substituted alkyl group include hydroxyl groups, alkoxy groups which have from 1 to 12 carbon atoms, cyano groups, amino groups, alkylamino groups which have from 1 to 12 carbon atoms, dialkylamino groups in which there are two alkyl groups which each have from 1 to 12 carbon atoms, halogen atoms and aryl groups which have from 6 to 15 carbon atoms. Examples of such groups include hydroxyalkyl groups (for example, hydroxymethyl, 2-hydroxyethyl, 3-hydroxypropyl, 2-hydroxypropyl), alkoxyalkyl groups (for example, methoxymethyl, 2-methoxyethyl, 3-methoxypropyl, ethoxymethyl, 2-ethoxyethyl), cyanoalkyl groups (for example, cyanomethyl, 2-cyanoethyl), aminoalkyl groups (for example, aminomethyl, 2-aminoethyl, 3-aminopropyl), (alkylamino)alkyl groups (for example, (methylamino)methyl, 2-(methylamino)ethyl, (ethylamino)methyl), (dialkylamino)alkyl groups (for example, (dimethylamino)methyl, 2-(dimethylamino)ethyl), halogenoalkyl groups (for example, fluoromethyl, chloromethyl, bromomethyl), and aralkyl groups (for example, benzyl, phenethyl).

Examples of substituent groups in those cases where $R^1$ represents a substituted phenyl group include hydroxyl groups, alkoxy groups which have from 1 to 12 carbon atoms, cyan groups, amino groups, alkylamino groups which have from 1 to 12 carbon atoms, dialkylamino groups in which there are two alkyl groups which each have from 1 to 12 carbon atoms, halogen atoms, alkyl groups which have from 1 to 6 carbon atoms and nitro groups. Specific examples of these groups include hydroxyphenyl groups, alkoxyphenyl groups (for example, methoxyphenyl, ethoxyphenyl), cyanophenyl groups, aminophenyl groups, (alkylamino)phenyl groups (for example, (methylamino)-phenyl, (ethylamino)phenyl)), (dialkylamino)phenyl groups (for example, (dimethylamino)phenyl), halogenophenyl groups (for example, fluorophenyl), chlorophenyl, bromophenyl), alkylphenyl groups (for example, tolyl, ethylphenyl, cumenyl, xylyl, mesityl), nitrophenyl groups and phenyl groups which have two or three of these substituent groups (which may be the same or different) (the position of the substituent group or the relative position of a plurality of substituent groups is optional).

$R^2$ is preferably a hydrogen atom, a lower alkyl group which has from 1 to 6 carbon atoms, a carbamoyl group, a carboxyl group, an alkoxycarbonyl group of which the alkoxy group has from 1 to 12 carbon atoms, an aryloxycarbonyl group of which the aryloxy group has from 6 to 20 carbon atoms, or a substituted or unsubstituted amino group.

Specific examples of substituted amino groups which can be represented by $R^2$ include methylamino, ethylamino, propylamino, phenylamino, tolylamino, benzylamino, phenethylamino, dimethylamino, diethylamino and diphenylamino.

Specific examples of lower alkyl groups which can be represented by $R^2$ include methyl, ethyl, propyl, butyl, iso-propyl and iso-butyl.

Specific examples of alkoxycarbonyl groups which can be represented by $R^2$ include methoxycarbonyl, ethoxycarbonyl, propoxycarbonyl, butoxycarbonyl, isopropoxycarbonyl and benzyloxycarbonyl.

Specific examples of aryloxycarbonyl groups which can be represented by $R^2$ include phenoxycarbonyl and toluoxycarbonyl.

$R^3$ preferably represents an alkyl group which has from 1 to 20 carbon atoms, an aromatic group which has from 6 to 20 carbon atoms such as a phenyl, naphthyl, or anthryl group, a 5 to 20 membered heterocyclic aromatic group which contains, for example, oxygen, nitrogen, sulfur, selenium, such as a dibenzofuranyl, carbazolyl, benzocarbazolyl, furyl, thienyl, pyridyl, imidazolyl, oxazolyl, thiazolyl, or benzofuranyl group, or substituted derivatives of these groups.

In those cases where $R^3$ represents a substituted or unsubstituted alkyl group, these groups may be the same as the groups described earlier as specific examples of substituted or unsubstituted alkyl groups for $R^1$.

In those cases where $R^3$ represents a substituted aromatic group such as a substituted phenyl or substituted naphthyl group, or a substituted heterocyclic group which contains a hetero atom, such as a substituted dibenzofuranyl or substituted carbazolyl group, the substituent groups may be hydroxyl groups, cyano groups, nitro groups, halogen atoms (for example, fluorine, chlorine or bromine), alkyl groups which have from 1 to 12 carbon atoms (for example, methyl, ethyl, propyl, isopropoxy), alkoxy groups which have from 1 to 12 carbon atoms (for example, methoxy, ethoxy, propoxy, butoxy, pentyloxy, iso-propoxy, iso-butoxy, iso-amyloxy, tert-butoxy, neo-pentyloxy), amino groups, alkylamino groups which have from 1 to 12 carbon atoms (for example, methylamino, ethylamino, propylamino), dialkylamino groups in which there are two alkyl groups which have from 1 to 12 carbon atoms each (for example, dimethylamino, diethylamino, N-methyl-N-ethylamino), arylamino groups which have from 6 to 12 carbon atoms, (for example, phenylamino, tolylamino), diarylamino groups in which there are two aryl groups, which have from 6 to 15 carbon atoms (for example, diphenylamino), carboxyl groups, alkali metal carboxylate groups (with $Na^+$, $K^+$ or $Li^+$, for example as the alkali metal (cation)), alkali metal sulfonate groups (with $Na^+$, $K^+$ or $Li^+$, for example as the alkali metal (cation)), alkylcarbonyl groups (for example, acetyl, propionyl, benzylcarbonyl), arylcarbonyl groups in which the aryl group has from 6 to 12 carbon atoms (for example, benzoyl, toluoyl), alkylthio groups which have from 1 to 12 carbon atoms (for example, methylthio, ethylthio), or arylthio groups which have from 6 to 12 carbon atoms (for example, phenylthio, tolylthio), and these groups may have from 1 to 3 substituent groups. In those cases where there is a plurality of substituent groups these groups may be the same or different, with any combination, and the substituent groups may be bonded in any positions.

In those cases where $R^4$ and $R^5$ are alkyl groups, aromatic groups or heterocyclic aromatic groups, or substituted derivatives thereof, these groups may be the same as those described as specific examples of the groups $R^3$.

In those cases where A represents

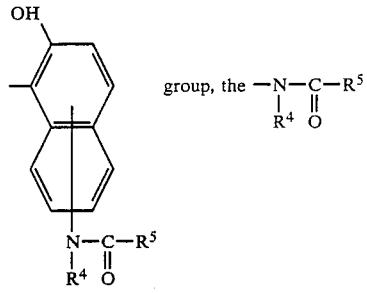

moiety can be substituted in any of the positions from the 3-position to the 8-position of the naphthalene ring, but it is preferably substituted in the 8-position.

B represents a divalent aromatic hydrocarbyl group which has 6 to 24 carbon atoms or a divalent 5 to 24 membered heterocyclic group in which a nitrogen atom is included in the ring, and in either case the group may be substituted with alkyl groups which have 1 to 12 carbon atoms, halogen atoms, nitro groups or hydroxyl groups. Examples of divalent aromatic hydrocarbyl groups include the o-phenylene, o-naphthylene, peri-naphthylene, 1,2-anthraquinonylene and 9,10-phenanthrylene groups. Examples of divalent heterocyclic groups in which a nitrogen atom is included in the ring include the 3,4-pyraxol-diyl, 2,3-pyridin-diyl, 4,5-pyrimidin-diyl, 6,7-indazol-diyl, 5,6-benzimidazol-diyl and 6,7-quinolin-diyl groups.

Examples of the groups represented by $Ar_1$, $Ar_2$, $Ar_3$ and $Ar_4$ include arylene groups such as phenylene, naphthalene, anthrylene, biphenylene and terphenylene, divalent groups derived from condensed poly-cyclic aromatic systems, such as indene, fluorene, accenaphtene, perylene, fluorenone, anthrone, anthraquinone, benzanthrone and isocoumarin, and divalent groups derived from heterocyclic aromatic systems, such as pyridine, quinoline, oxazole, thiazole, oxadiazole, benzoxazole, benzimidazole, benzothiazole, benzotriazole, dibenzofuran, carbazole and xanthene.

In those cases where $Ar_1$ and $Ar_2$, $Ar_2$ and $Ar_3$, and $Ar_3$ and $Ar_4$, from together with the nitrogen atom and a group of other atoms, a ring, this ring may be, for example, a carbazole ring, an acridone ring, a phenoxazine ring or a phenothiazine ring.

In those cases where $Ar_1$, $Ar_2$, $Ar_3$ and $Ar_4$ have substituent groups, the substituent groups may be, for example, hydroxyl groups, alkoxy groups which have from 1 to 18 carbon atoms, cyano groups, alkylamino groups which have from 1 to 18 carbon atoms, dialkylamino groups which have two alkyl groups which have from 1 to 18 carbon atoms, halogen atoms, aryl groups which have from 6 to 15 carbon atoms, acyl groups which have up to 18 carbon atoms, and acyloxy groups which have up to 18 carbon atoms.

Specific examples are described below, but the invention is not limited by these examples. Thus, the group of compounds indicated below can be cited as specific examples of the tris-azo compounds of the present invention.

$A_1$ in these compounds represents a coupler residual group as indicated in Tables 1 to 3, and L represents a —C≡C— group.

(1)

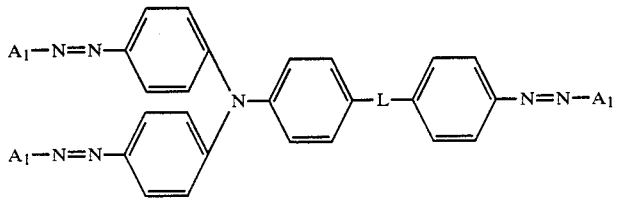

(2)

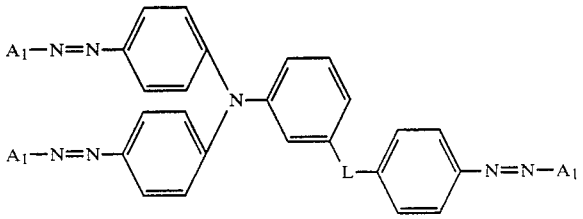

(3)

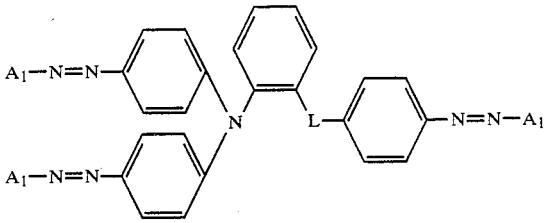

(4)

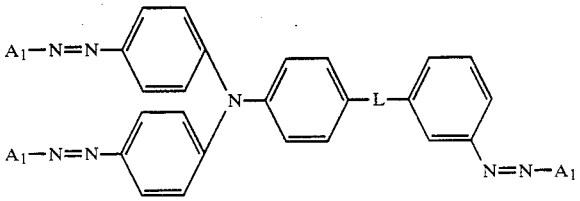

(5)

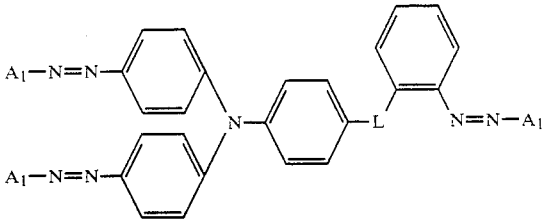

-continued
(6)
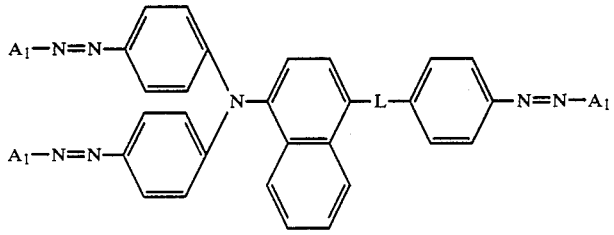
(7)
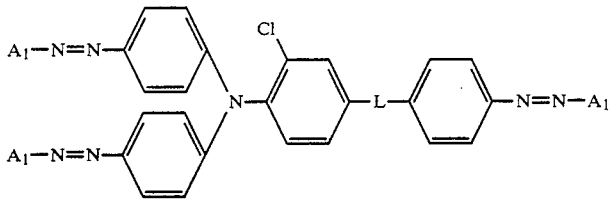
(8)
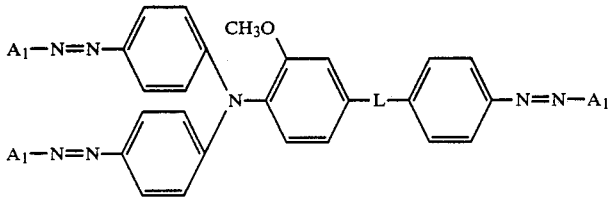
(9)
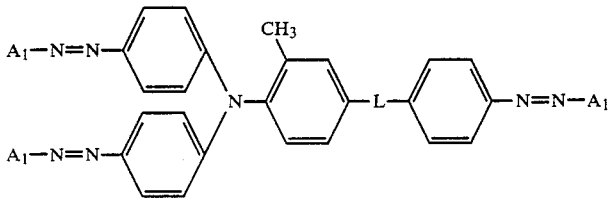
(10)
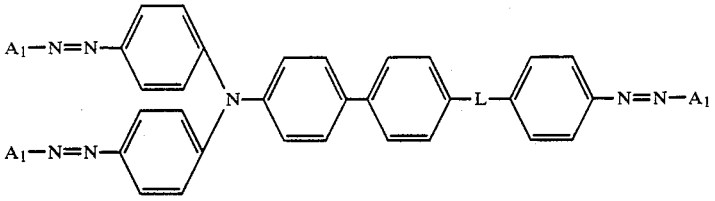
(11)
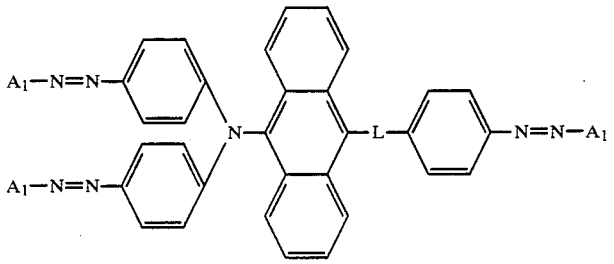
(12)
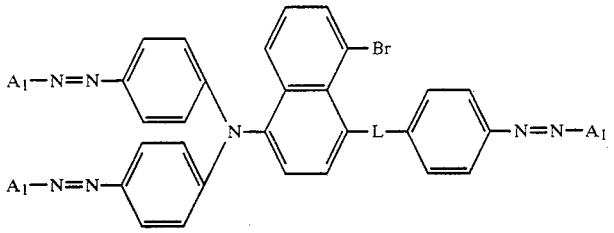

-continued
(13)
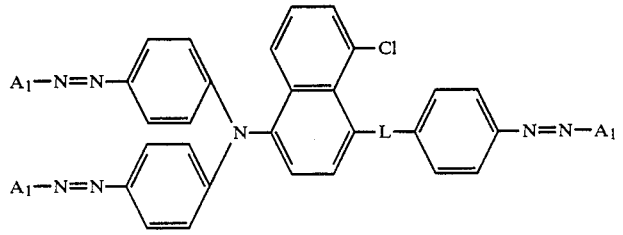
(14)
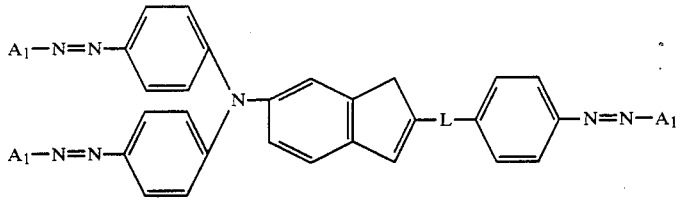
(15)
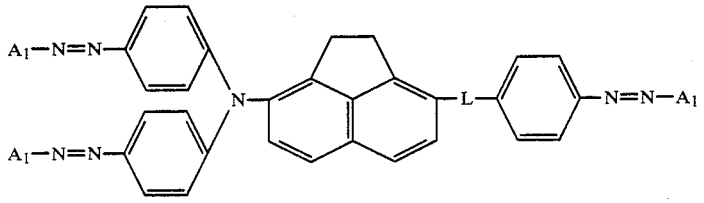
(16)
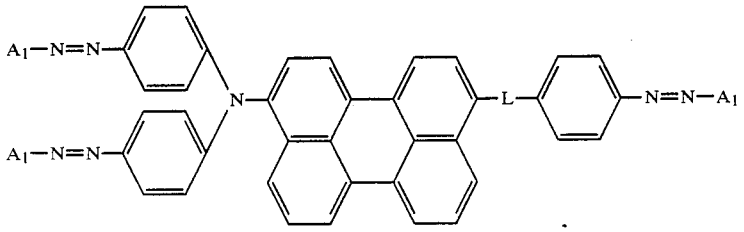
(17)
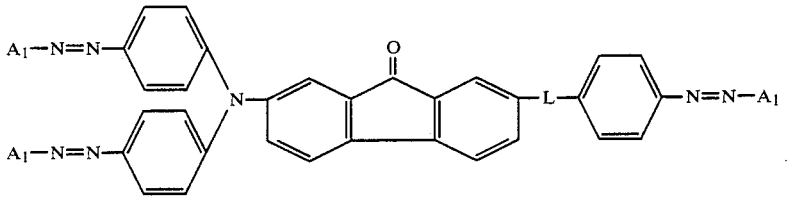
(18)
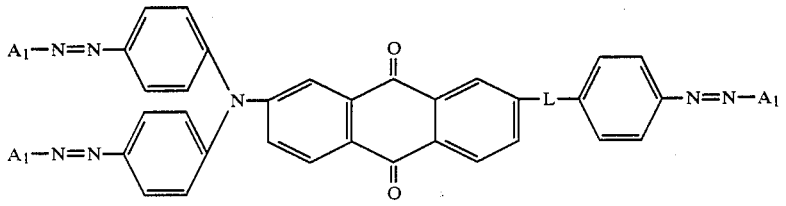
(19)
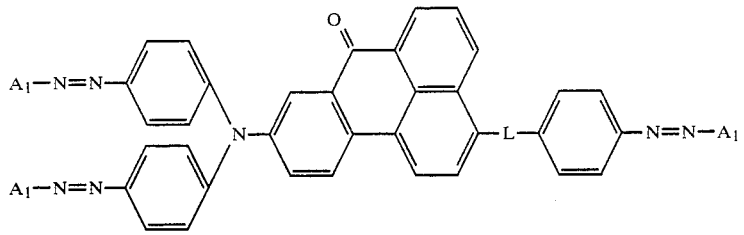

-continued
(20)
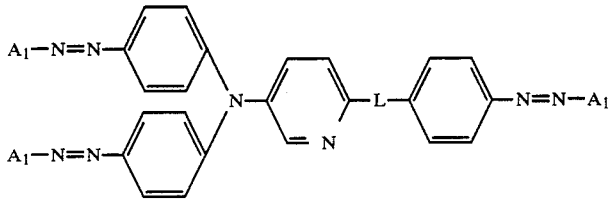
(21)
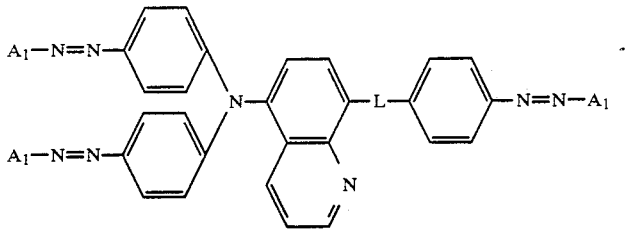
(22)
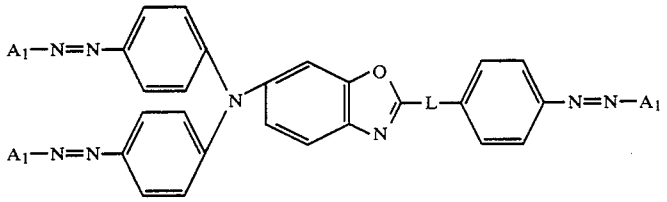
(23)
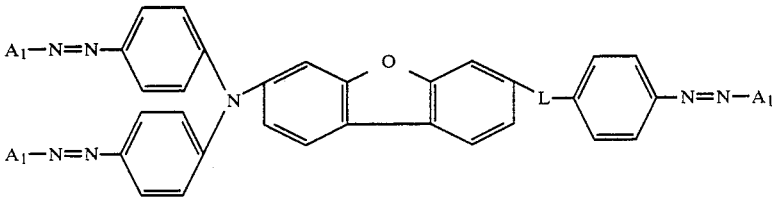
(24)
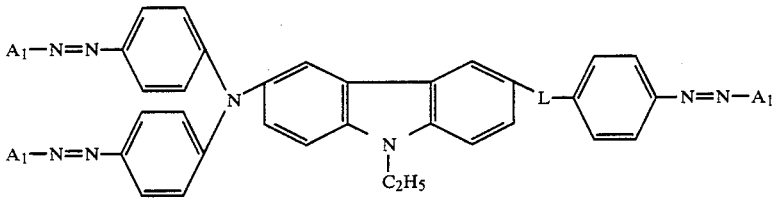
(25)
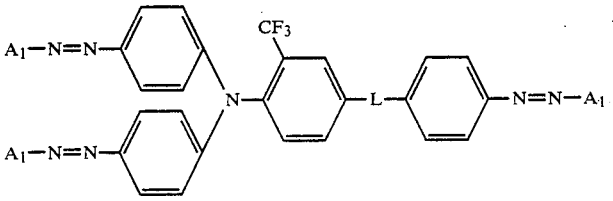
(26)
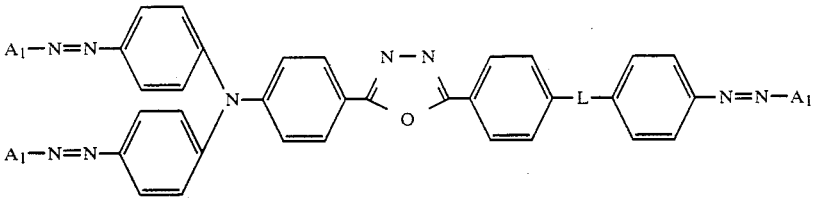

-continued
(27)
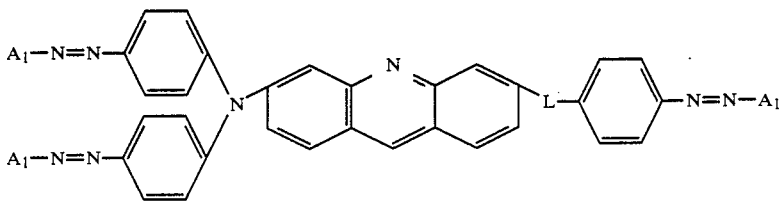
(28)
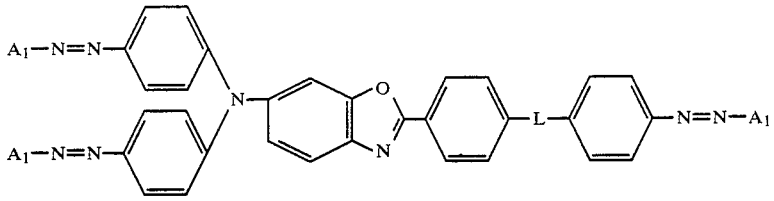
(29)
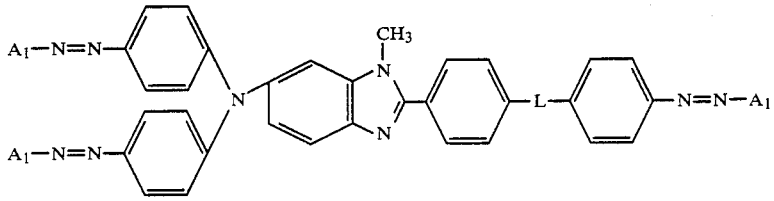
(30)
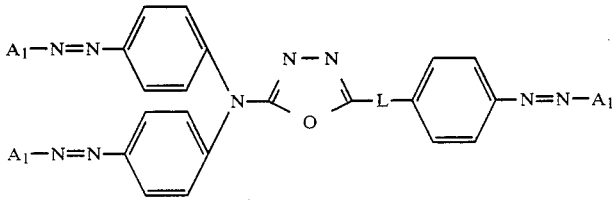
(31)
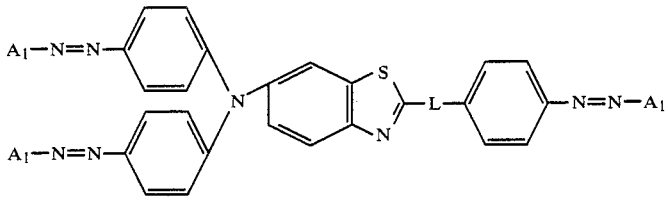
(32)
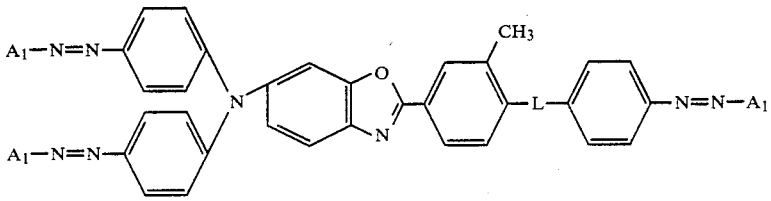
(33)
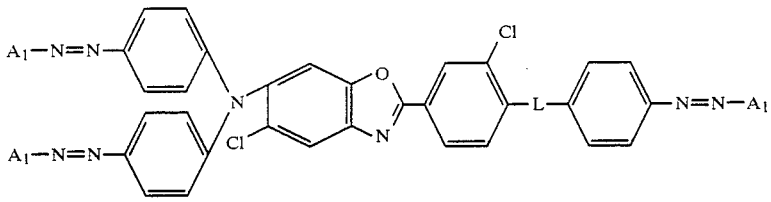

-continued
(34)
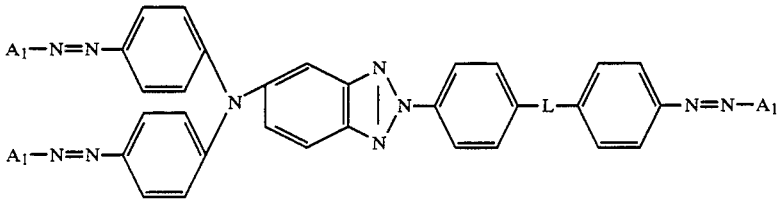
(35)
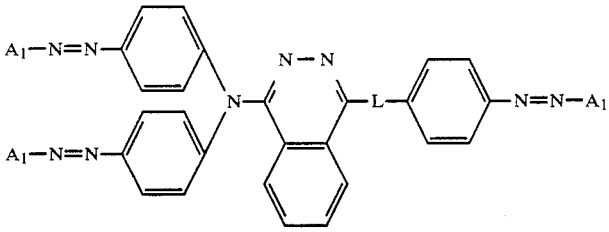
(36)
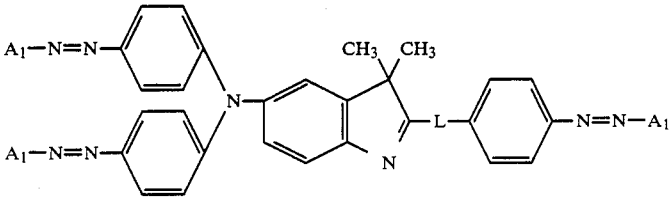
(37)
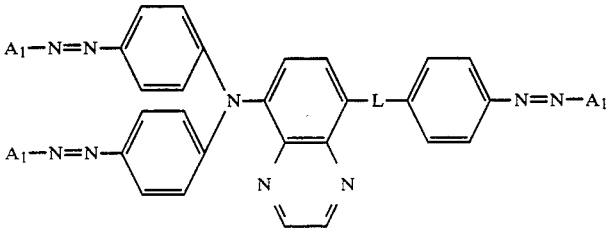
(38)
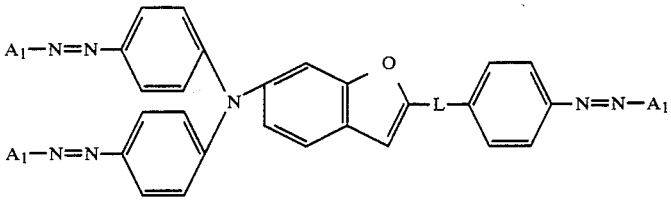
(39)
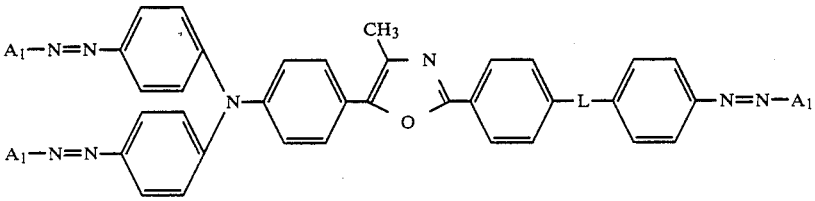
(40)
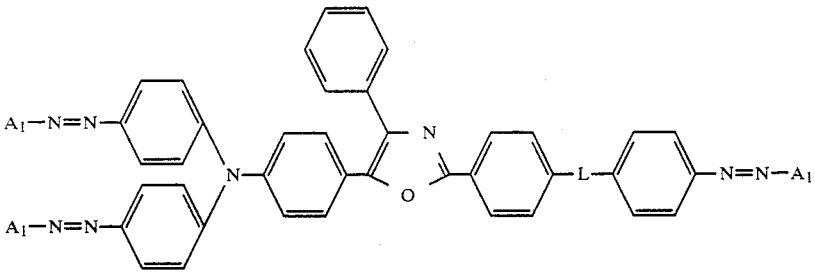

-continued
(41)
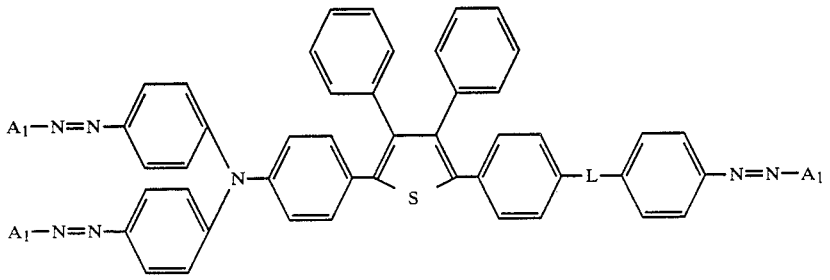
(42)
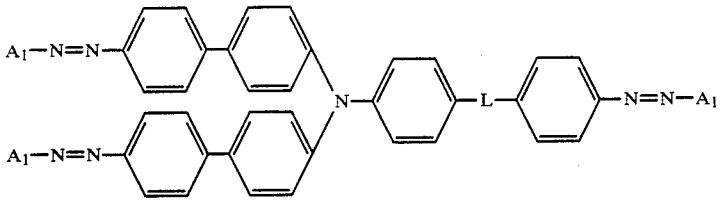
(43)
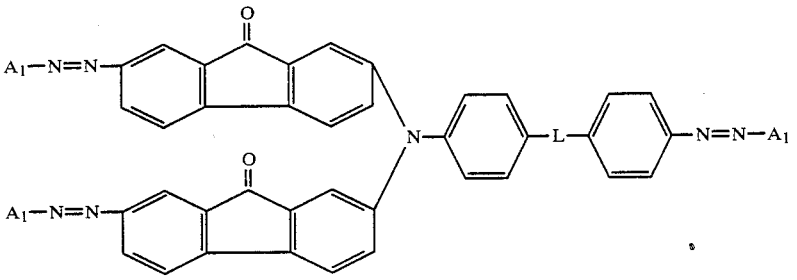
(44)
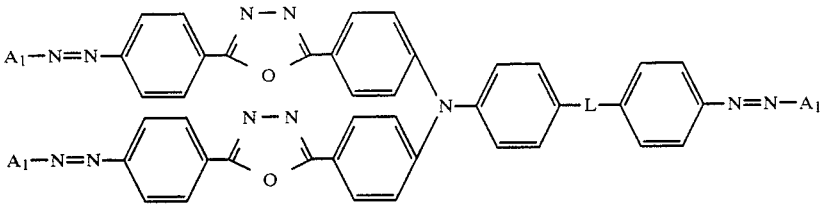
(45)
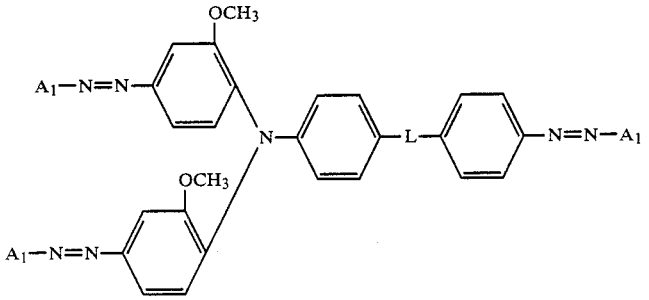
(46)
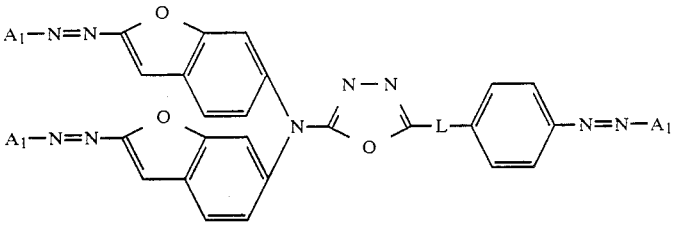

-continued
(47)
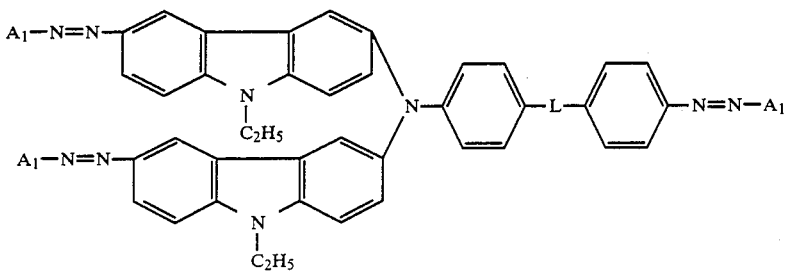
(48)
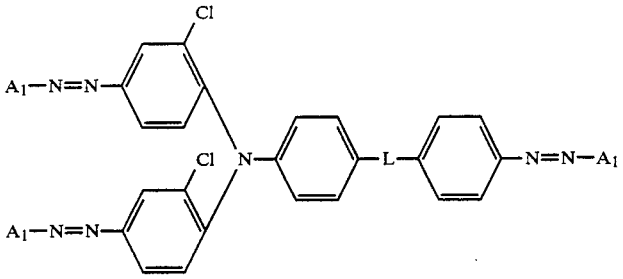
(49)
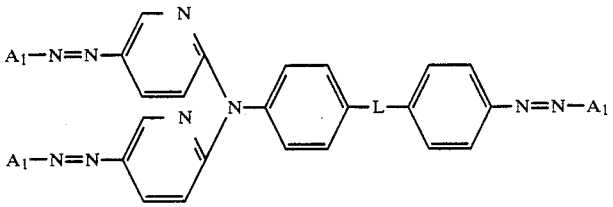
(50)
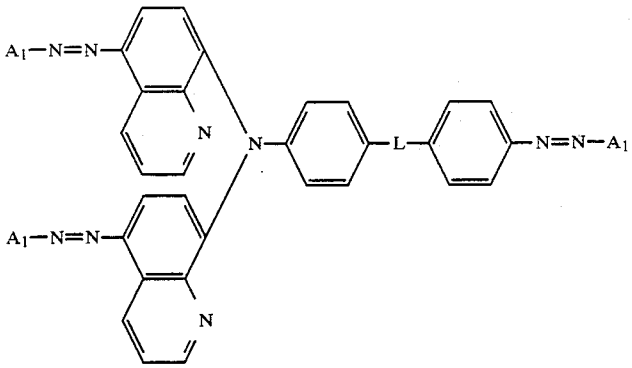
(51)
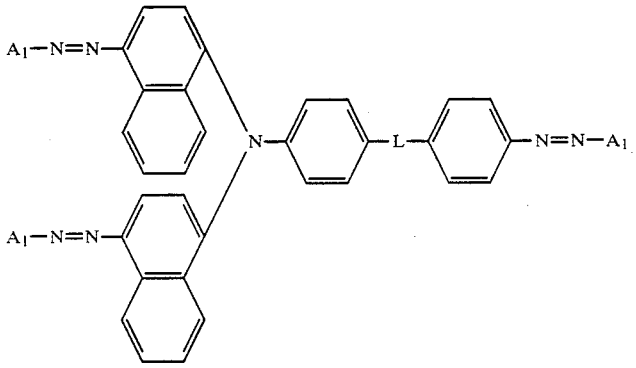

-continued
(52)
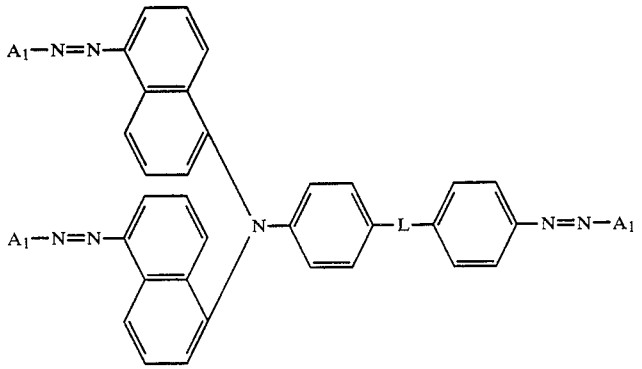
(53)
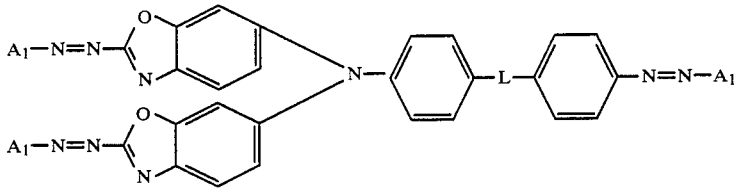
(54)
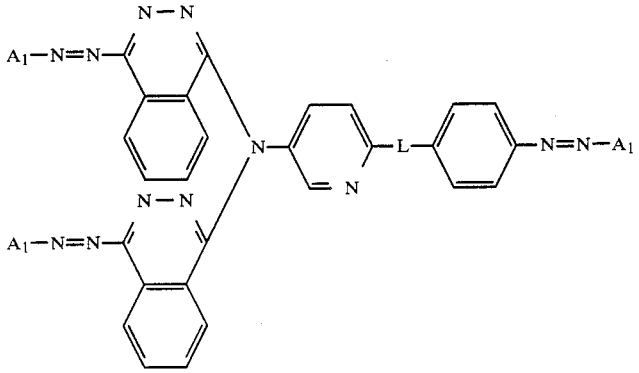
(55)
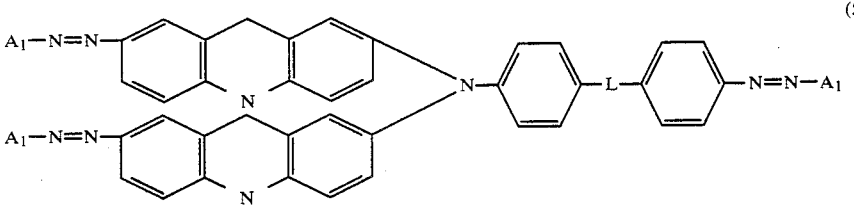
(56)
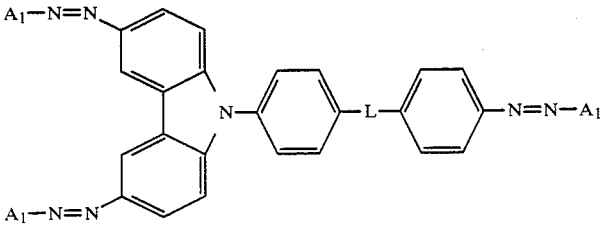
(57)
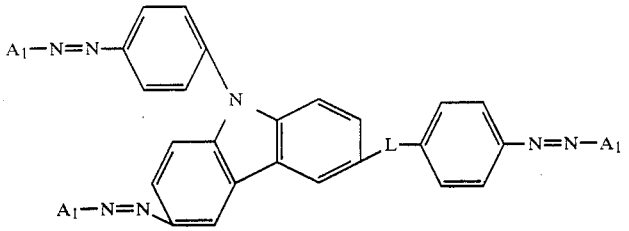

-continued
(58)
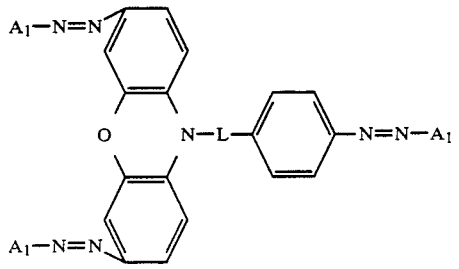
(59)
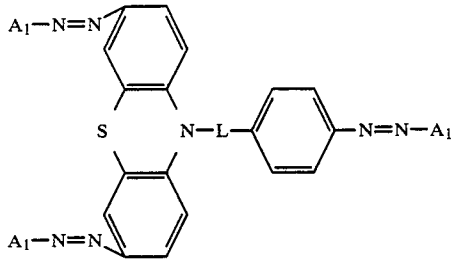
(60)
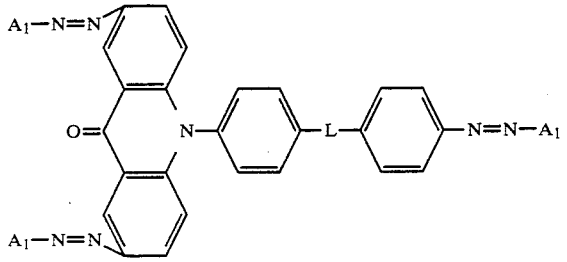
(61)
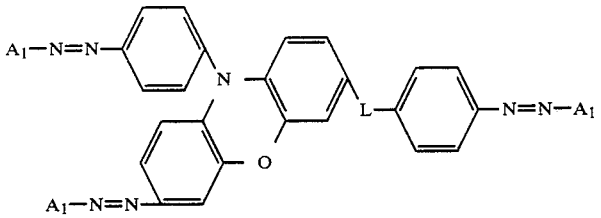
(62)
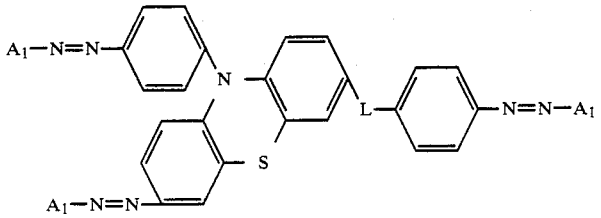
(63)
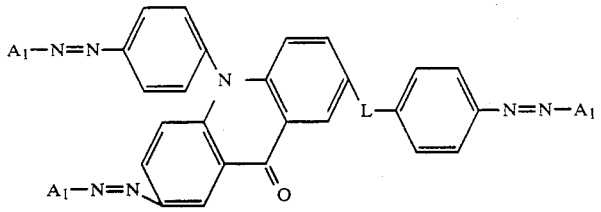

-continued
(64)
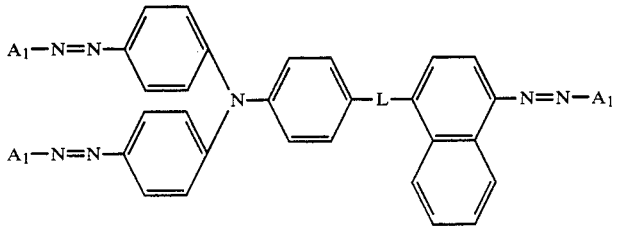
(65)
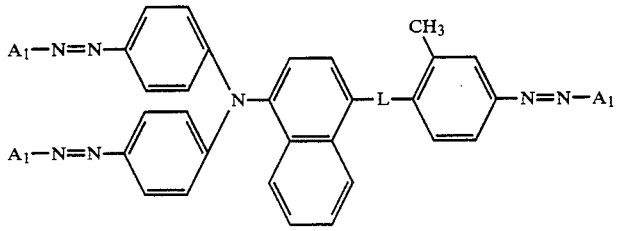
(66)
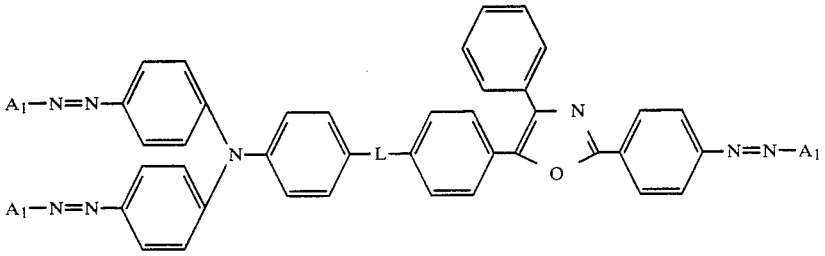
(67)
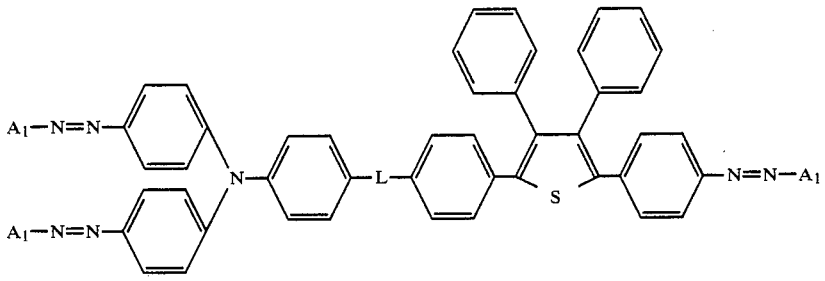
(68)
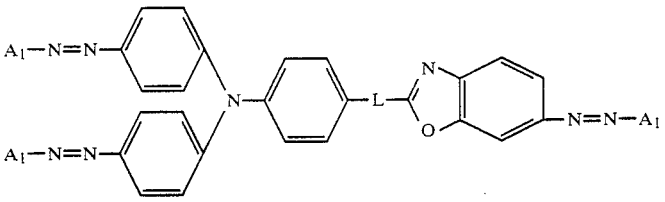

-continued
(69)
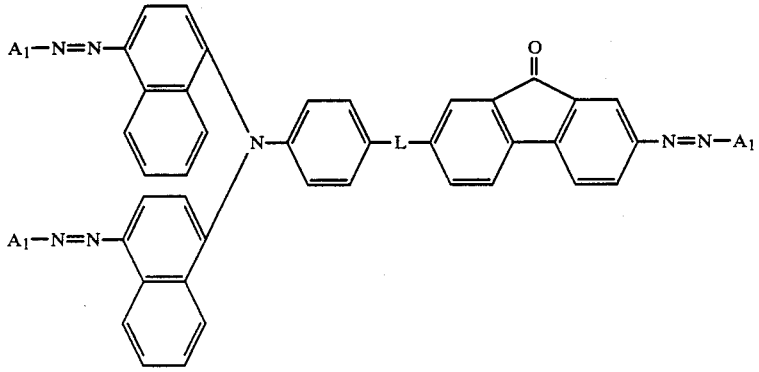
TABLE 1
| $A_1$ | $A_1$ |
|---|---|
| ($A_1$-1) | 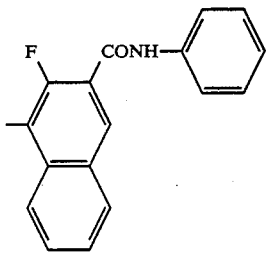 |
| ($A_1$-2) | 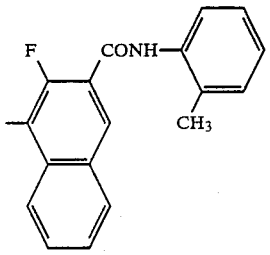 |
| ($A_1$-3) | 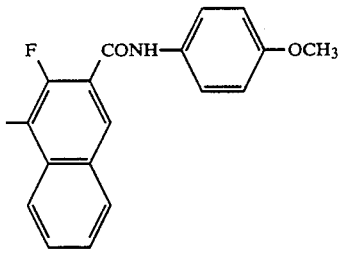 |
| ($A_1$-4) | 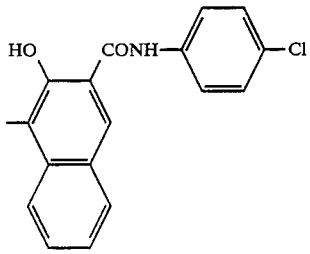 |
TABLE 1-continued
| $A_1$ | $A_1$ |
|---|---|
| ($A_1$-5) | 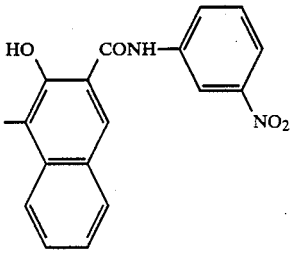 |
| ($A_1$-6) | 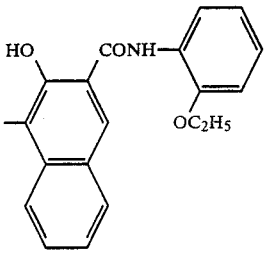 |
| ($A_1$-7) | 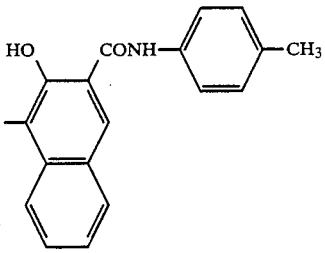 |
| ($A_1$-8) | 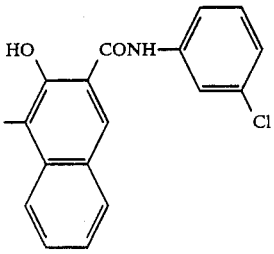 |

TABLE 1-continued
| $A_1$ | $A_1$ |
|---|---|
| ($A_1$-9) | 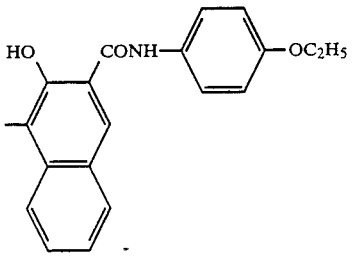 |
| ($A_1$-10) | 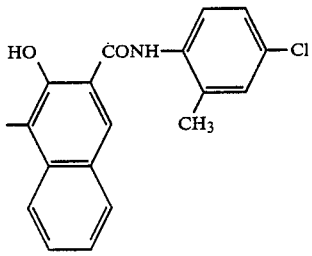 |
| ($A_1$-11) | 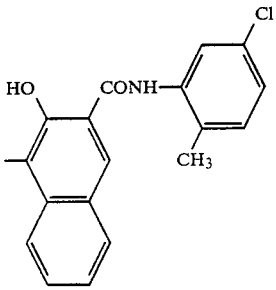 |
| ($A_1$-12) | 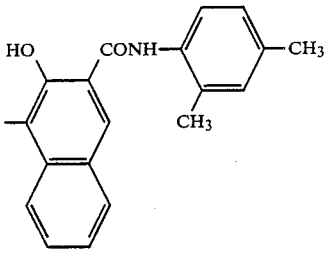 |
| ($A_1$-13) | 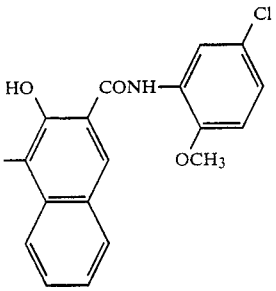 |
TABLE 1-continued
| $A_1$ | $A_1$ |
|---|---|
| ($A_1$-14) | 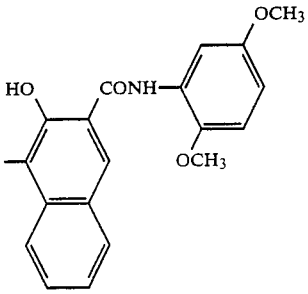 |
| ($A_1$-15) | 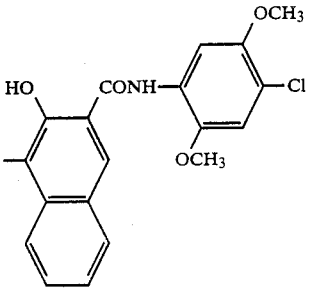 |
| ($A_1$-16) | 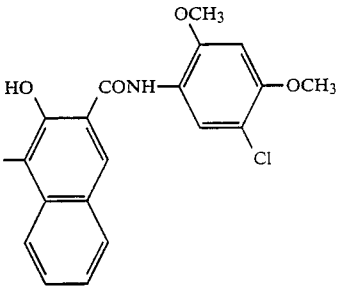 |
| ($A_1$-17) | 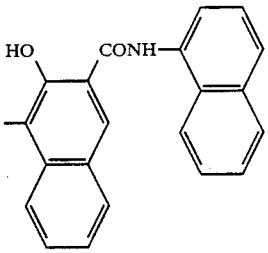 |
| ($A_1$-18) | 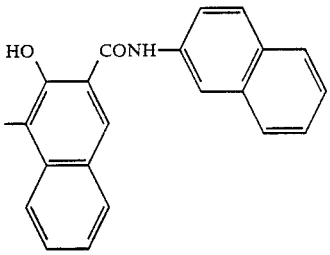 |

TABLE 1-continued
| $A_1$ | $A_1$ |
|---|---|
| ($A_1$-19) | 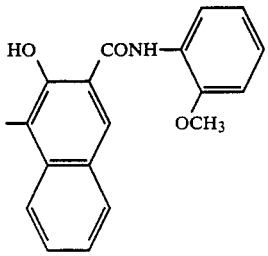 |
| ($A_1$-20) | 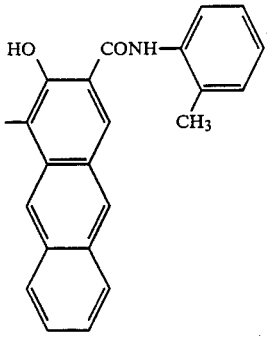 |
| ($A_1$-21) | 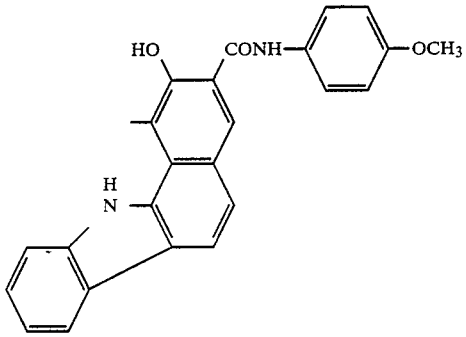 |
| ($A_1$-22) | 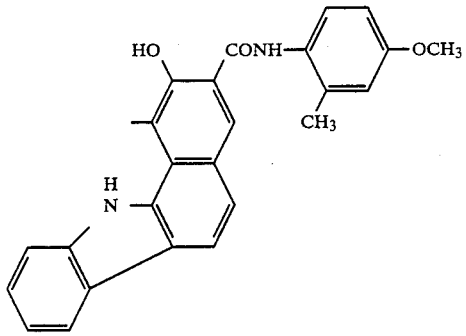 |
| ($A_1$-23) | 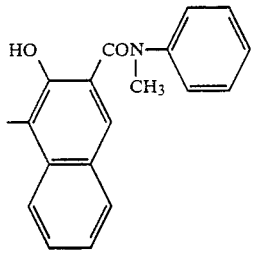 |
TABLE 1-continued
| $A_1$ | $A_1$ |
|---|---|
| ($A_1$-24) | 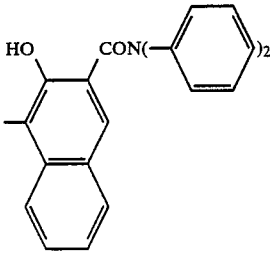 |
| ($A_1$-25) | 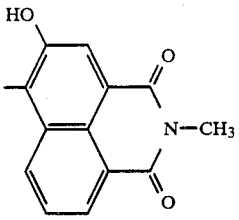 |
| ($A_1$-26) | 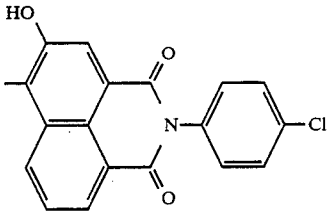 |
| ($A_1$-27) | 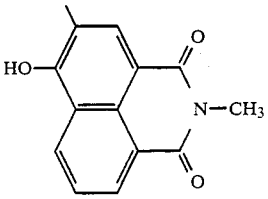 |
| ($A_1$-28) | 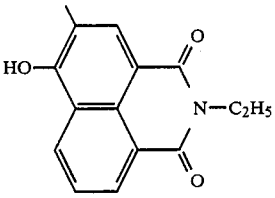 |
| ($A_1$-29) | 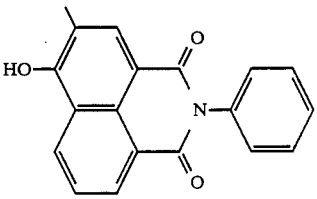 |
| ($A_1$-30) | 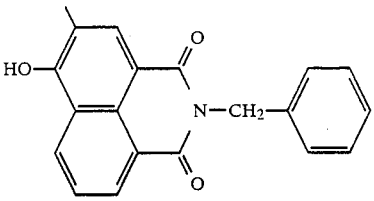 |

TABLE 1-continued
| $A_1$ | $A_1$ |
|---|---|
| ($A_1$-31) | 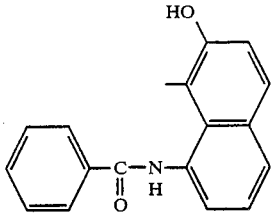 |
| ($A_1$-32) | 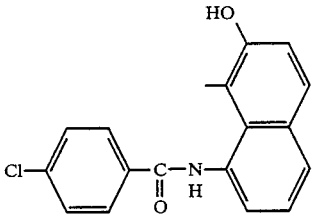 |
TABLE 1-continued
| $A_1$ | $A_1$ |
|---|---|
| ($A_1$-33) | 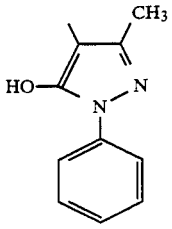 |
| ($A_1$-34) | 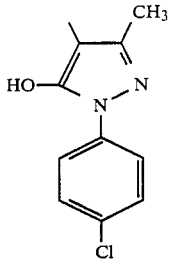 |
| ($A_1$-35) | 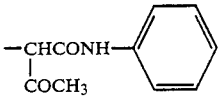 |
| ($A_1$-36) | 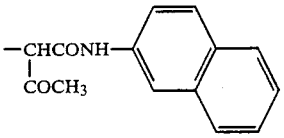 |

TABLE 2
| $A_1$ | Ar | | | | | |
|---|---|---|---|---|---|---|
| | 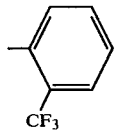 | 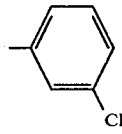 | 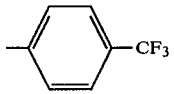 | 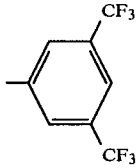 | 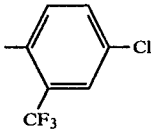 | 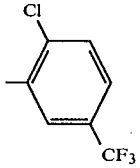 |
| 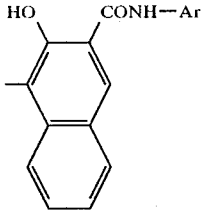 | $A_1$-37 | $A_1$-38 | $A_1$-39 | $A_1$-40 | $A_1$-41 | $A_1$-42 |
| 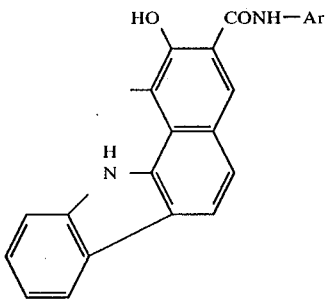 | $A_1$-49 | $A_1$-50 | $A_1$-51 | $A_1$-52 | $A_1$-53 | $A_1$-54 |
| 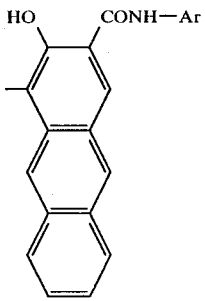 | $A_1$-61 | $A_1$-62 | $A_1$-63 | $A_1$-64 | $A_1$-65 | $A_1$-66 |

TABLE 2-continued
| | | | | | | |
|---|---|---|---|---|---|---|
| 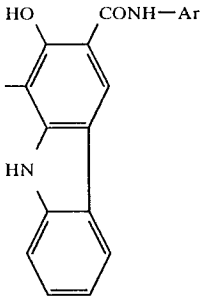 | $A_1$-73 | $A_1$-74 | $A_1$-75 | $A_1$-76 | $A_1$-77 | $A_1$-78 |
| 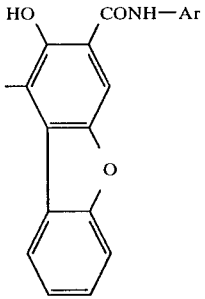 | $A_1$-85 | $A_1$-86 | $A_1$-87 | $A_1$-88 | $A_1$-89 | $A_1$-90 |
| | Ar | | | | | |
| | 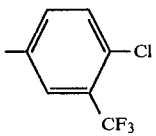 | 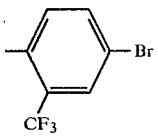 | 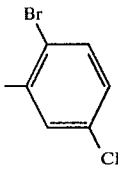 | 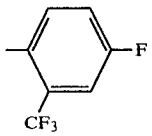 | 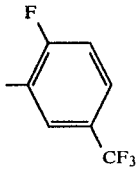 | 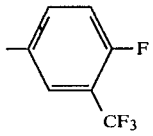 |
| $A_1$ | $A_1$-43 | $A_1$-44 | $A_1$-45 | $A_1$-46 | $A_1$-47 | $A_1$-48 |
| 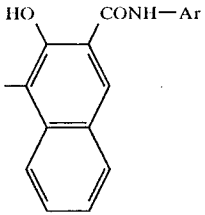 | | | | | | |

TABLE 2-continued
| | | | | | | |
|---|---|---|---|---|---|---|
| 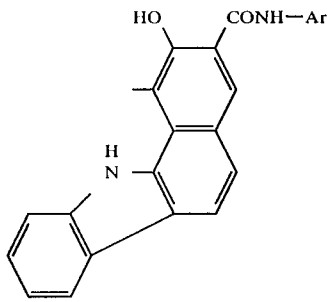 | $A_1$-55 | $A_1$-56 | $A_1$-57 | $A_1$-58 | $A_1$-59 | $A_1$-60 |
| 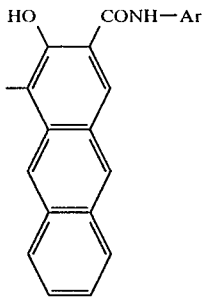 | $A_1$-67 | $A_1$-68 | $A_1$-69 | $A_1$-70 | $A_1$-71 | $A_1$-72 |
| 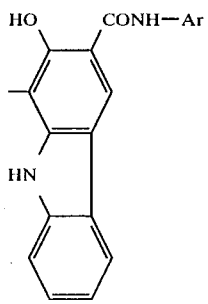 | $A_1$-79 | $A_1$-80 | $A_1$-81 | $A_1$-82 | $A_1$-83 | $A_1$-84 |

TABLE 2-continued
| | | | | | | |
|---|---|---|---|---|---|---|
| 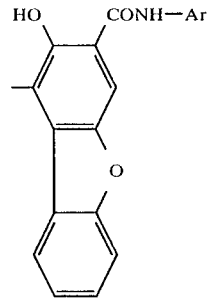 | $A_1$-91 | $A_1$-92 | $A_1$-93 | $A_1$-94 | $A_1$-95 | $A_1$-96 |
| | Ar | | | | | |
| $A_1$ | 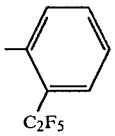 | 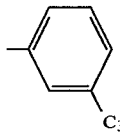 | 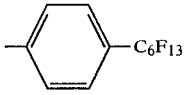 | 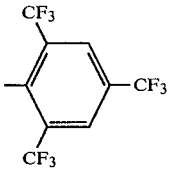 | 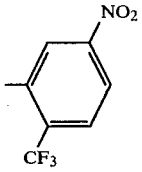 | 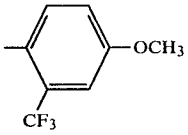 |
| 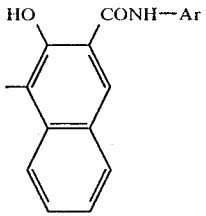 | $A_1$-97 | $A_1$-98 | $A_1$-99 | $A_1$-100 | $A_1$-101 | $A_1$-102 |
| 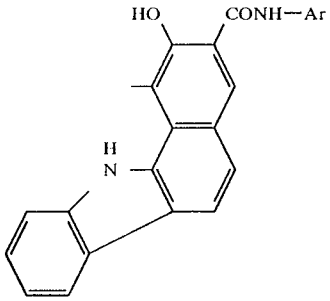 | $A_1$-109 | $A_1$-110 | $A_1$-111 | $A_1$-112 | $A_1$-113 | $A_1$-114 |

TABLE 2-continued
| | | | | | | |
|---|---|---|---|---|---|---|
| 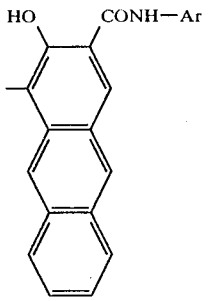 | $A_1$-121 | $A_1$-122 | $A_1$-123 | $A_1$-124 | $A_1$-125 | $A_1$-126 |
| 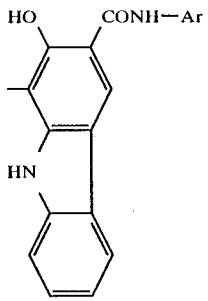 | $A_1$-133 | $A_1$-134 | $A_1$-135 | $A_1$-136 | $A_1$-137 | $A_1$-138 |
| 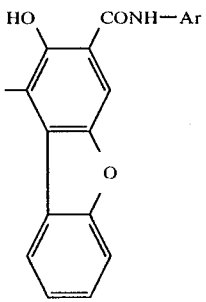 | $A_1$-145 | $A_1$-146 | $A_1$-147 | $A_1$-148 | $A_1$-149 | $A_1$-150 |
| | Ar | | | | | |

TABLE 2-continued
| $A_1$ | 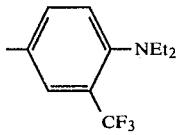 | 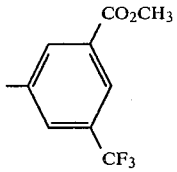 | 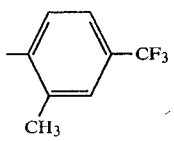 | 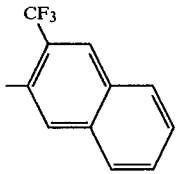 | 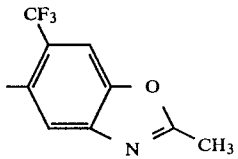 | 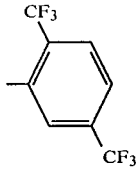 |
|---|---|---|---|---|---|---|
| 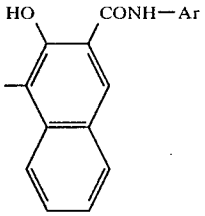 | $A_1$-103 | $A_1$-104 | $A_1$-105 | $A_1$-106 | $A_1$-107 | $A_1$-108 |
| 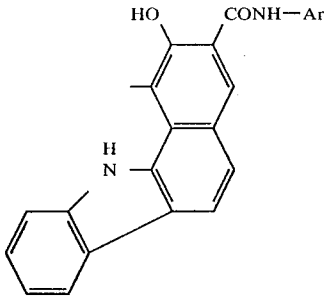 | $A_1$-115 | $A_1$-116 | $A_1$-117 | $A_1$-118 | $A_1$-119 | $A_1$-120 |
| 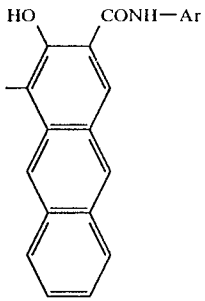 | $A_1$-127 | $A_1$-128 | $A_1$-129 | $A_1$-130 | $A_1$-131 | $A_1$-132 |

TABLE 2-continued
| | | | | | | |
|---|---|---|---|---|---|---|
| 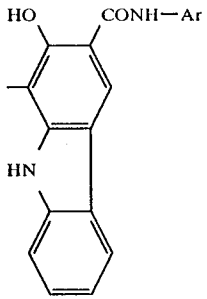 | $A_1$-139 | $A_1$-140 | $A_1$-141 | $A_1$-142 | $A_1$-143 | $A_1$-144 |
| 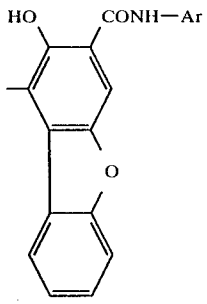 | $A_1$-151 | $A_1$-152 | $A_1$-153 | $A_1$-154 | $A_1$-155 | $A_1$-156 |

TABLE 3
| $A_1$ | $A_1$ |
|---|---|
| ($A_1$-157) | 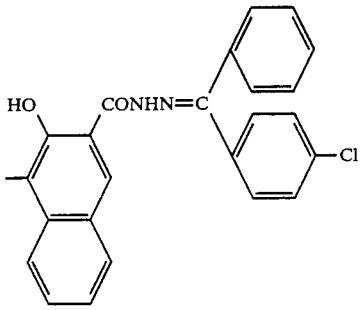 |
| ($A_1$-158) | 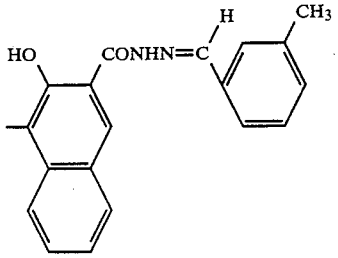 |
| ($A_1$-159) | 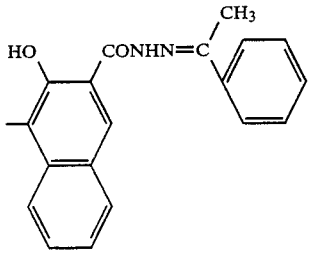 |
| ($A_1$-160) | 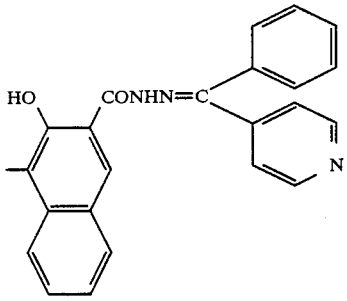 |
| ($A_1$-161) | 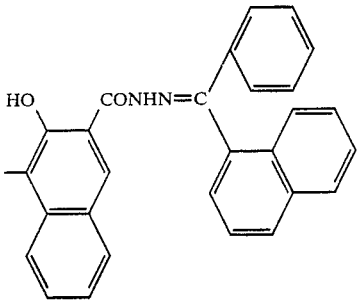 |
TABLE 3-continued
| $A_1$ | $A_1$ |
|---|---|
| ($A_1$-162) | 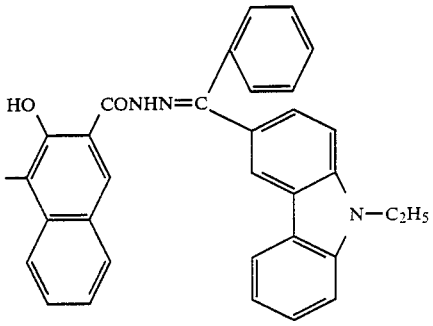 |
| ($A_1$-163) | 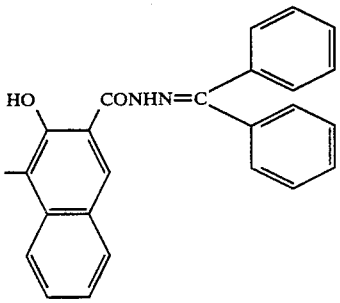 |
| ($A_1$-164) | 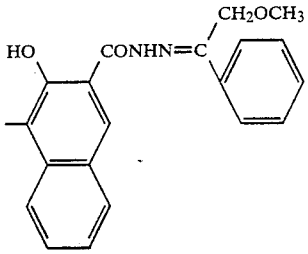 |
| ($A_1$-165) | 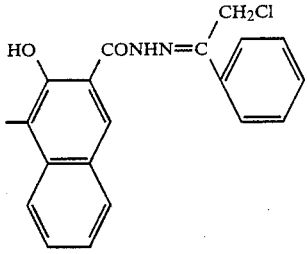 |
| ($A_1$-166) | 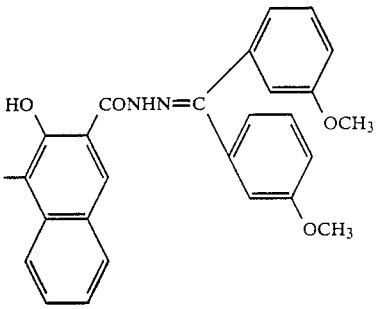 |

TABLE 3-continued
| $A_1$ | $A_1$ |
|---|---|
| ($A_1$-167) | 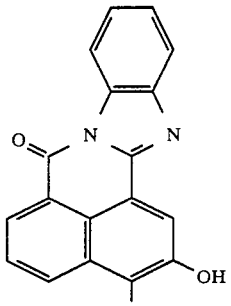 |
| ($A_1$-168) | 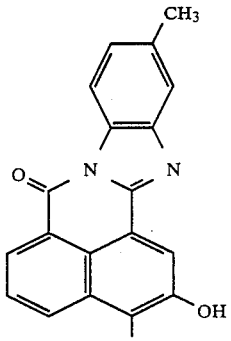 |
| ($A_1$-169) | 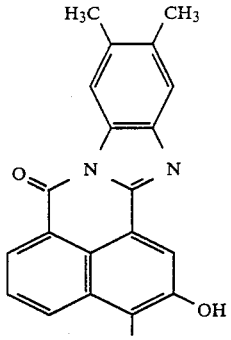 |
| ($A_1$-170) | 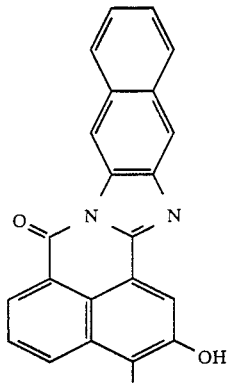 |
TABLE 3-continued
| $A_1$ | $A_1$ |
|---|---|
| ($A_1$-171) | 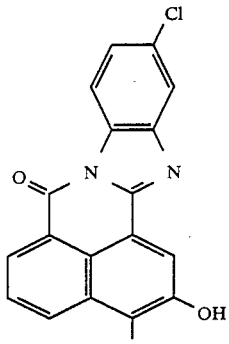 |
| ($A_1$-172) | 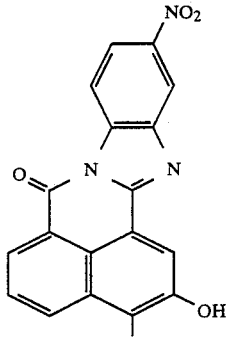 |
| ($A_1$-173) | 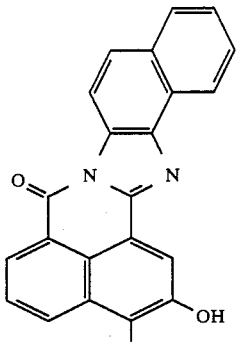 |
| ($A_1$-174) | 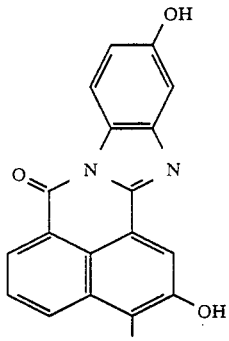 |

TABLE 3-continued
| $A_1$ | $A_1$ |
|---|---|
| ($A_1$-175) | 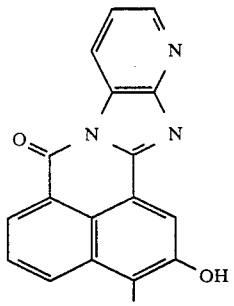 |
| ($A_1$-176) | 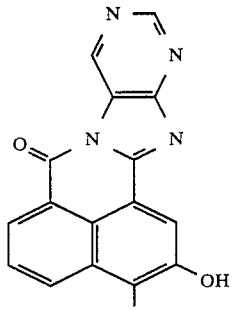 |
| ($A_1$-177) | 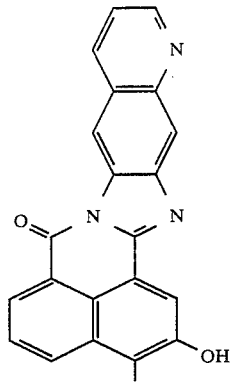 |
| ($A_1$-178) | 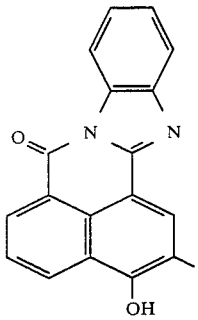 |
TABLE 3-continued
| $A_1$ | $A_1$ |
|---|---|
| ($A_1$-179) | 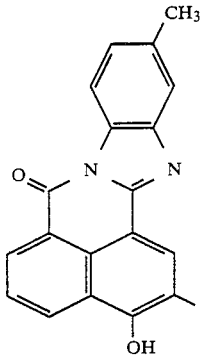 |
| ($A_1$-180) | 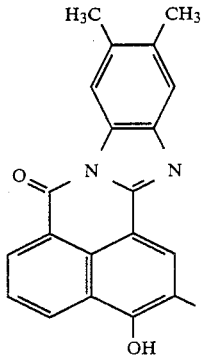 |
| ($A_1$-181) | 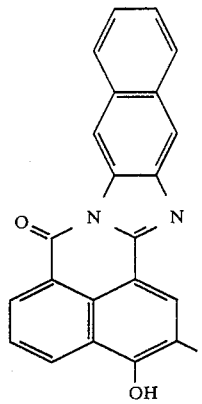 |
| ($A_1$-182) | 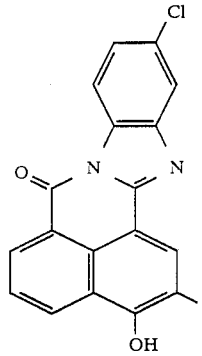 |

TABLE 3-continued

| $A_1$ | $A_1$ |
|---|---|
| ($A_1$-183) | 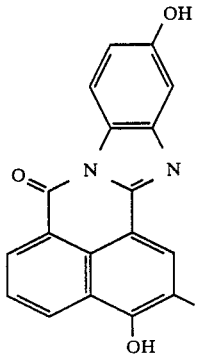 |

TABLE 3-continued

| $A_1$ | $A_1$ |
|---|---|
| ($A_1$-184) | 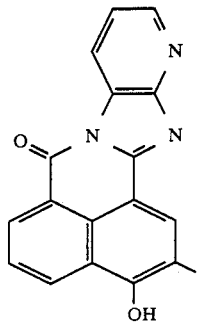 |

The novel tris-azo compounds of the present invention can be prepared easily using known methods. Fore example, they can be prepared easily by diazotizing an amino compound represented by the general formula (II) in the usual way and carrying out coupling with a coupler in the presence of an alkali, or by carrying out a coupling reaction with a coupler in the presence of an alkali in a solvent such as N,N-dimethylformamide or dimethylsulfoxide after isolating the diazonium salt in the form of a borofluorohydride or a zinc chloride complex.

The preparation of compound (I-1), in which $A_1$ in the compounds of group No. 1 is $A_1$-21, as shown in Table 1, is illustrated below in synthesis example 1. Other tris-azo compounds can be prepared in the same way.

General Formula (II)

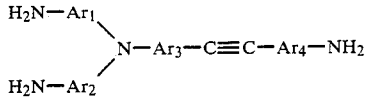

$Ar_1$, $Ar_2$, $Ar_3$ and $Ar_4$ in this formula have the same meaning as in general formula (I).

Synthesis Example 1 Compound Group No. 1 ($A_1$=$A_1$-21) Preparation of (1—1)

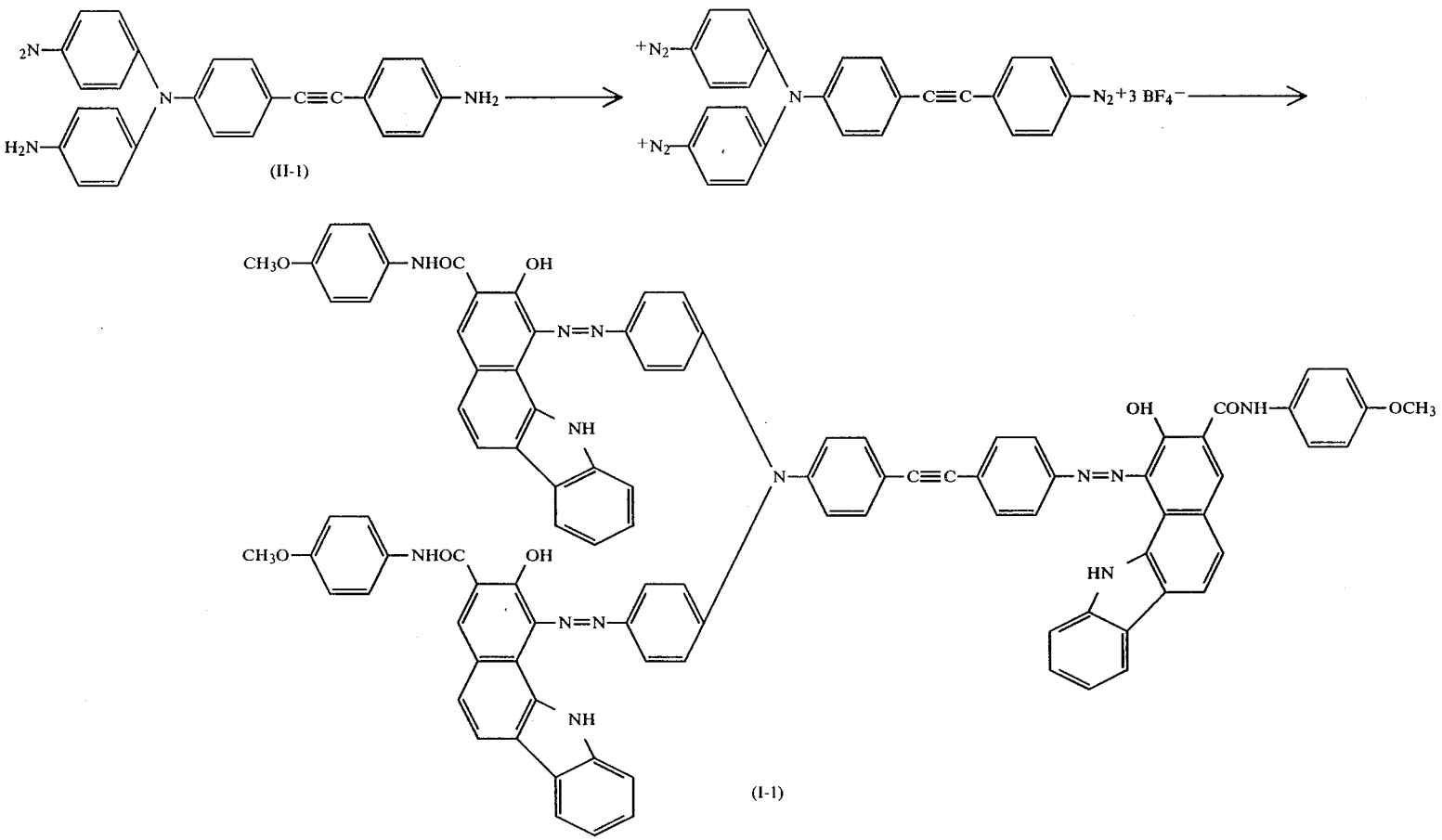
(II-1)
(I-1)

A mixture comprising 6 grams of the amino compound (II-1), 9 ml of concentrated hydrochloric acid, and 60 ml of water was cooled to 0° C. and a solution obtained by dissolving 3.9 grams of sodium nitrite in 9 ml of water was added dropwise over a period of 10 minutes. After stirring the mixture for 1 hour at 0° C., 19.5 ml of hydrofluoboric acid was added and the mixture was stirred for a further period of 30 minutes. The crystals which precipitated out were recovered by filtration, washed with water and dried, whereupon the diazonium salt was obtained. Recovery 9.8 grams (yield 92%, based on II-1)

A liquid mixture comprising 4.4 grams of the aforementioned diazonium salt, 9 grams of the coupler ($A_1$-21)-H and 300 ml or DMF was cooled to 10° C. and a solution obtained by dissolving 4.2 grams of sodium acetate in 18 ml of water was added dropwise to this liquid mixture over a period of 15 minutes. The mixture was then stirred for 3 hours at 10° C., after which the crystals which had precipitated out were recovered by filtration and washed repeatedly in sequence with N,N-dimethylformamide, acetone and water and then dried, whereupon (I-1) was obtained as a black powder. Recovery 6.1 grams (yield 60%, based on the diazonium salt), $\lambda_{max}=587$ nm ($\epsilon=5.8\times10^4$) (in N,N-dimethylformamide/ethylenediamine=95/5 by volume solution)

Synthesis Example 2 Preparation of Compound Group No. 1 ($A_1=A_1$-185)

A liquid mixture comprising 4.4 grams of the diazonium salt obtained in synthesis example 1, 9.2 grams of the coupler ($A_1$-185)-H and 350 ml of DMF was cooled to 10° C. and an aqueous solution obtained by dissolving 4.2 grams of sodium acetate in 18 ml of water was added dropwise to this mixture over a period of 15 minutes. The mixture was then stirred for a period of 3 hours at 10° C., after which the crystals which had precipitated out were recovered by filtration and washed repeatedly in sequence with N,N-dimethylformamide, acetone and water and then dried, whereupon compound group No. 1 ($A_1=A_1$-185) was obtained. Recovery 5.9 grams (yield 57%, based on the diazonium salt), $\lambda_{max}=590$ grams ($\epsilon=5.6\times10^4$) (in N,N-dimethylformamide/ethylenediamine=95/5 by volume solution)

The electrophotographic photoreceptors of the present invention have an electrophotographic photosensitive layer which contains one or more tris-azo compounds which can be represented by the aforementioned general formula (I). Various embodiments of electrophotographic photoreceptors are known, and the electrophotographic photoreceptors of the present invention may be any type photoreceptor, but the normal types of electrophotographic photoreceptors are indicated below.

(I) Those in which an electrophotographic photosensitive layer in which the tris-azo compound is dispersed in a charge carrier transporting medium is established on an electrically conductive support.

(II) Those in which a charge carrier generating layer in which a tris-azo compound is a principal component is established on an electrically conductive support and in which a charge carrier transporting layer is established over the said layer.

(III) Those in which a charge carrier transporting layer is established on an electrically conductive support and in which a charge carrier generating layer in which a tris-azo compound is a principal component is established over the said layer.

The tris-azo compounds of the present invention act in such a way as to generate charge carriers with a high efficiency when they absorb light. The charge carriers which are produced are transported by means of a charge carrier transporting compound.

Fine particles of the azo compound are dispersed in a solution obtained by dissolving a charge carrier transporting compound or a solution obtained by dissolving a charge carrier transporting compound and a binder and this dispersion is coated onto an electrically conductive support and dried in order to make an electrophotographic photoreceptor of type (I). The thickness of the electrophotographic photosensitive layer at this time is from 3 to 30$\mu$, and preferably from 5 to 20$\mu$.

A tris-azo compound is vacuum vapor deposited on an electrically conductive support, or the tris-azo compound is dissolved in a solvent such as an amine and coated onto the support, or fine particles of the tris-azo compound are dispersed in a suitable solvent, or in a solvent in which a binder has been dissolved, if required, and coated onto the support and dried, after which a solution which contains a charge carrier transporting compound and a binder is coated over the said layer and dried in order to form an electrophotographic photoreceptor of type (II). The thickness of the tris-azo compound which forms the charge carrier generating layer in this case is from 4$\mu$ to 0.1$\mu$, and preferably from 2$\mu$ to 0.3$\mu$, and the thickness of the charge carrier transporting medium layer is from 3 to 30$\mu$, and preferably from 5 to 20$\mu$.

An electrophotographic photoreceptor of type (III) can be made by reversing the order of the layer formation for an electrophotographic photoreceptor of type (II).

The azo compounds used in the photoreceptors of types (I), (II) and (III) are pulverized for use in a dispersing machine such as a ball mill, a sand mill or a vibration mill, for example, to a particle size of from 5$\mu$ to 0.1$\mu$, and preferably of from 2$\mu$ to 0.2$\mu$.

When used in a type (I) electrophotographic photoreceptor, the use of too little of tris-azo compound results in poor photosensitivity while the use of too much may result in poor charging properties or poor electrophotographic photosensitive layer film strength, and when a binder is used the proportion of tris-azo compound used in the electrophotographic photosensitive layer is within the range from 0.01 to 2, and preferably from 0.05 to 1, times by weight the weight of binder, and the proportion of charge carrier transporting compound is within the range from 0.1 to 2, and preferably from 0.3 to 1.3, times by weight the weight of binder. Furthermore, in those cases where the charge carrier transporting compound can itself be used as a binder, the amount of tris-azo compound added is preferably from 0.01 to 0.5 times by weight the weight of charge carrier transporting compound.

In those cases in which the tris-azo containing layer which forms the charge carrier generating compound containing layer is formed by coating in type (II) or type (III) electrophotographic photoreceptors, the amount of tirs-azo compound used is preferably from 0.1 to 20 times by weight the weight of binder resin, and satisfactory photosensitivity cannot be obtained with smaller amounts. Furthermore, it is possible to omit the binder from the charge carrier generating layer. The proportion of charge carrier transporting compound in the charge carrier transporting compound layer is preferably from 0.2 to 2 times by weight, and more preferably from 0.3 to 1.3 times by weight, the weight of binder. However, in those cases where a polymeric charge carrier transporting compound which can itself be used as a binder is used it is possible to omit any other binder.

Metal plates of aluminum, copper or zinc for example, plastic sheets or films, such as polyester sheets or films, on which an electrically conductive material such as aluminum, indium oxide or $SnO_2$ for example have been vapor deposited or dispersion coated, plastic films which have been coated with an acetonitrile solution of copper iodide, or papers which have been rendered electrically conductive by treatment with an inorganic salt such as sodium chloride or potassium chloride, or an organic quaternary ammonium salt can be used, for example as the electrically conductive supports which are used in the electrophotographic photoreceptors of the present invention.

Additives such as plasticizers or sensitizers etc. can be used together with the binder (or with the charge carrier transporting compound which functions as a binder) when forming electrophotographic photoreceptors of the present invention.

The binders which are used when a binder is used are preferably electrically insulating film forming polymers which are hydrophobic and which have a high dielectric constant. Examples of such macromolecular polymers are indicated below, but of course the binder is not limited by these examples.

Polycarbonates, polyesters, methacrylic resins, acrylic resins, poly(vinyl chloride), poly(vinylidene chloride), polystyrene, poly(vinyl acetate), styrene/-butadiene copolymers, vinylidene chloride/acrylonitrile copolymers, vinyl chloride/vinyl acetate copolymers, vinyl chloride/vinyl acetate/maleic anhydride copolymers, silicone resins, silicone/alkyd resins, phenol/formaldehyde resins, styrene/alkyd resins and poly(N-vinylcarbazole).

These binders can be used individually or in the form of mixtures of two or more types.

Examples of plasticizers which can be used include biphenyl, chlorinated biphenyl, o-terphenyl, p-terphenyl, dibutyl phthalate, dimethylglycol phthalate, dioctyl phthalate, triphenyl phosphate, methylnaphthalene, benzophenone, chlorinated paraffins, polypropylene, polystyrene, dilaurylthiodipropionate, 3,5-dinitrosalicylic acid and various fluorohydrocarbons.

Silicone oils, for example, may also be added to improve the surface properties of the electrophotographic photoreceptor.

Chloranil, tetracyanoethylene, methyl violet, rhodamine B, cyanine dyes, merocyanine dyes, pyrylium dyes and thiapyrylium dyes, for example, can be used as sensitizers.

In general, the compounds which transport charge carriers can be classified into two types, namely compounds which transport electrons and compounds which transport positive holes, and either type can be used in the electrophotographic photoreceptors of the present invention. Compounds which have electron attracting groups, for example, 2,4,7-trinitro-9-fluorenone, 2,4,5,7-tetranitro-9-fluorenone, 9-dicyanomethylene-2,4,7-trinitrofluorenone, 9-dicyanomethylene-2,4,5,7-tetranitrofluorenone, tetranitrocarbazole-chloranil, 2,3-dichloro-5,6-dicyanobenzoquinone, 2,4,7-trinitro-9,10-phenanthrenequinone, tetrachlorophthalic acid anhydride, tetracyanoethylene and tetracyanoquinodimethane, can be used as compounds which transport electrons.

Compounds which have electron donating groups can be used as compounds which transport positive holes. Some examples of polymeric compounds of this type are indicated below.

(1) The polyvinylcarbazoles and derivatives thereof disclosed in JP-B-34-10966.

(2) Vinyl polymers, such as the polyvinylpyrene, polyvinylanthracene, poly(2-vinyl-4-(4'-dimethylaminophenyl)-5-phenyloxazole), and poly(3-vinyl-N-ethylcarbazole disclosed in JP-B-43-18674 and JP-B-43-19192.

(3) Polymers such as the polyacenaphthalene, polyindene and acenaphthalene/styrene copolymers disclosed in JP-B-43-19193.

(4) Condensed resins such as the pyrene/formaldehyde resins, bromopyrene/formaldehyde resins and ethylcarbazole/formaldehyde resins disclosed, for example, in JP-B-56-13940.

(5) The various triphenylmethane polymers disclosed in JP-A-56-90883 and JP-A-56-161550.

Some examples of lower molecular weight compounds of this type are indicated below.

(6) The triazole derivative disclosed, for example, in U.S. Pat. No. 3,112,197.

(7) The oxadiazole derivatives disclosed, for example, in U.S. Pat. No. 3,189,447.

(8) The imidazole derivatives disclosed, for example, in JP-B-37-16096.

(9) The polyarylalkane derivatives disclosed, for example, in U.S. Pat. Nos. 3,615,402, 3,820,989 and 3,542,544, JP-B-45-555, JP-B-51-10983, JP-A-51-93224, JP-A-55-108667, JP-A-55-156953 and JP-A-56-36656.

(10) The pyrazoline or pyrazolone derivatives disclosed, for example, in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637 and JP-A-55-74546.

(11) The phenylenediamine derivatives disclosed, for example, in U.S. Pat. No. 3,615,404, JP-B-51-10105, JP-A-54-83435, JP-A-54-110836, JP-A-54-119925, JP-B-46-3721 and JP-B-47-28336.

(12) The arylamine derivatives disclosed, for example, in U.S. Pat. No. 3,567,450, JP-B-49-35702, West German Patent (DAS) No. 1,110,518, U.S. Pat. Nos. 3,180,703, 3,240,597, 3,658,520, 4,232,103, 4,175,961 and 4,012,376, JP-A-55-144250, JP-A-56-119132, JP-B-39-27577 and JP-A-56-22437.

(13) The amino substituted chalcone derivatives disclosed in U.S. Pat. No. 3,526,501.

(14) The N,N-bicarbazyl derivatives disclosed, for example, in U.S. Pat. No. 3,542,546.

(15) The oxazole derivatives disclosed, for example, in U.S. Pat. No. 3,257,203.

(16) The styrylanthracene derivatives disclosed, for example, in JP-A-56-46234.

(17) The fluorenone derivatives disclosed, for example, in JP-A-54-110837.

(18) The hydrazone derivatives disclosed, for example, in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749 and JP-A-57-104144.

(19) The benzidine derivatives disclosed, for example, in U.S. Pat. Nos. 4,047,948, 4,047,949, 4,265,990, 4,273,846, 4,299,897 and 4,306,008.

(20) The stilbene derivatives disclosed in JP-A-58-190953, JP-A-59-95540, JP-A-59-97148, JP-A-59-195658 and JP-A-62-36674.

Moreover, in the present invention the compound which transports the charge carriers is not limited to the compounds indicated in (1) to (20) above, and use can be made of all of the charge carrier transporting compounds known at the present time.

Depending of the particular case, two or more of these charge transporting materials can be used conjointly.

Moreover, adhesive layers or barrier layers can be established, as required, between the electrically conductive support and the photosensitive layer in the photoreceptors obtained in the ways described above. Materials which can be used in these layers include the aforementioned macromolecular polymers which can be used as binders, and gelatin, casein, poly(vinyl alcohol), ethylcellulose, carboxymethylcellulose, the vinylidene based polymer latexes disclosed in JP-A-59-84247, the styrene/butadiene based polymer latexes disclosed in JP-A-59-114544, and aluminum oxide, for example, and the thickness of such a layer is preferably not more than 1 μm.

Measures for preventing the occurrence of the interference fringes which are produced when coherent light such as laser light is used to make the exposure can be taken, as required, in the photoreceptors obtained in the ways described above. Such techniques include the establishment of an underlayer which has a light scattering reflecting surface as disclosed in JP-A-60-186850, the establishment of titanium black containing underlayer as disclosed in JP-A-60-184258, methods in which most of the light from the light source is absorbed by the charge generating layer as disclosed in JP-A-58-82249, methods in which a micro phase separation structure is formed in the charge transporting layer as disclosed in JP-A-61-18963, methods in which a substance which absorbs or scatters the coherent light is admixed with the photoconductive layer as disclosed in JP-A-60-86550, methods in which concavities of depth at least one quarter of the wavelength of the coherent light are established in the surface of the photoreceptor as disclosed in JP-A-63-106757, and methods in which a light scattering layer or a light absorbing layer is established on the back of a transparent support as disclosed in JP-A-62-172371 and JP-A-62-174771.

The electrophotographic photoreceptors of the present invention have been described in detail above, and in general terms they are characterized by having a high sensitivity and excellent durability.

The electrophotographic photoreceptors of the present invention can be used in a wide range of applications including use as photoreceptors in printers in which lasers or Braun tubes are used as light sources as well as in electrophotographic copying machines.

Photoconductive compositions which contain the tris-azo compounds of the present invention can also be used as the photoconductor layer in the known solid state imaging devices which have a light receiving layer (photoconductive layer) established over the whole surface of a semiconductor circuit which is arrayed in one or two dimensions with which signal transmission and scanning can be carried out, or as the photoconductive layers in the camera tubes of video cameras. Furthermore, they can also be used as the photoconductive layers in solar batteries, as described by A. K. Ghosh & Tom Feng in J. Appl. Phys., 49 (12), 5982 (1978).

Further, the tris-azo compounds of the present invention can also be used as photoconductive colored grains in photoelectrophoresis system or as colored grains in a dry or wet electrophotographic developer.

The tris-azo compounds of the present invention can be dispersed in alkali soluble resin solutions such as phenol resins together with the aforementioned charge carrier transporting compounds such as oxadiazole derivatives or hydrazone derivatives for example, as disclosed in JP-B-37-17162, JP-A-55-19063, JP-A-55-161250 and JP-A-57-147656, and coated onto an electrically conductive support such as an aluminum support, for example, and dried to provide high sensitivity printing plates which have a high resolving power and a high durability by the processes of imagewise exposure, toner development, and etching with an aqueous alkali solution, and printed circuits can also be made in this way.

The invention is described by means of actual examples below, but the invention is not limited by these examples. Moreover, the term "parts" as used in these example signifies "parts by weight".

EXAMPLE 1

Five parts of the tris-azo compound (I-1) prepared in the Synthesis Example 1 was dispersed for 20 hours in a ball mill with a solution obtained by dissolving 5 parts of polyester resin (trade name "Vylon 200", made by TOYOBO CO., LTD.) in 50 parts of tetrahydrofuran, after which the dispersion was coated using a wire round rod onto an electrically conductive support (a support comprising a vapor deposited film of aluminum on the surface of a poly(ethylene terephthalate) film of thickness 75 μm, surface electrical resistance $4\times10^2\ \Omega$) and dried to prepare a charge generating layer of thickness 0.5 μm.

Next, a solution obtained by dissolving 3.6 parts of p-(diphenylamino)benzaldehydo-N'-methyl-N'-phenylhydrazine (see formula below) and 4 parts of bisphenol A polycarbonate in 13.3 parts of dichloromethane and 26.6 parts of 1,2-dichloroethane was coated using a wire round rod over the charge generating layer and dried to from a charge transporting layer of thickness 11 μm and an electrophotographic photoreceptor which had an electrophotographic photosensitive layer comprised of two layers was obtained in this way.

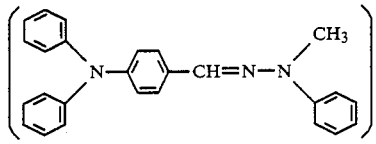

This photoreceptor was charged by means of a −6 KV coronal discharge to an initial surface potential $V_0$ and then it was irradiated with light in such a way as to provide a luminance at the surface of the photoreceptor of 30 lux using the light from a tungsten lamp and the exposure $E_{50}$ required to reduce the surface potential to half the initial potential $V_0$ and the surface potential (residual potential) $V_R$ after a 60 lux.sec. exposure were measured.

The same measurements were made after repeating the process 3000 times. The results obtained are shown in Table 4.

TABLE 4

| | First Time | 3000th Time |
|---|---|---|
| $V_0$ (V) | −620 | −610 |
| $E_{50}$ (Lux. Sec) | 1.6 | 1.8 |
| $V_R$ (V) | −5 | −7 |

EXAMPLES 2-12

Electrophotographic photoreceptors which had a two-layer structure were prepared in the same way as in Example 1 except that the compounds indicated in Table 5 were used in place of the tris-azo compound (I-1) in Example 1, and the values of the initial potential $V_0$ and the half reduction exposure $E_{50}$ were measured in each case in the same way as in Example 1. The results obtained are shown in Table 5.

TABLE 5

| Example No. | Compound Group No. | Azo compound $A_1$ | $V_0$ (V) | $E_{50}$ (lux · Sec) |
|---|---|---|---|---|
| 2 | (1) | $A_1$ − 5 | −687 | 1.9 |
| 3 | (1) | $A_1$ − 20 | −710 | 2.1 |
| 4 | (1) | $A_1$ − 22 | −645 | 1.5 |
| 5 | (1) | $A_1$ − 26 | −720 | 3.4 |
| 6 | (1) | $A_1$ − 34 | −770 | 2.3 |
| 7 | (1) | $A_1$ − 4 | −730 | 1.7 |
| 8 | (1) | $A_1$ − 75 | −800 | 1.6 |
| 9 | (1) | $A_1$ − 157 | −700 | 2.1 |
| 10 | (17) | $A_1$ − 160 | −700 | 2.2 |
| 11 | (28) | $A_1$ − 167 | −690 | 2.0 |
| 12 | (41) | $A_1$ − 185 | −650 | 1.9 |

EXAMPLE 13

Dichloromethane (660 parts) was added to 5 parts of the tris-azo compound (I-1), 40 parts of the hydrazone compound used in Example 1 and 100 parts of a benzyl methacrylate/methacrylic acid copolymer ($[\eta]=0.12$ in methyl ethyl ketone at 30° C., methacrylic acid content 32.9%) and the mixture was dispersed ultrasonically.

The dispersion was coated onto a sanded aluminum plate of thickness 0.25 mm and dried to prepare an electrophotographic photosensitive printing plate which had an electrophotographic photosensitive layer of dry thickness 6 mm.

The sample was charged in the dark using a coronal discharge to provide a photosensitive layer surface potential of about +600 V, after which the sample surface was exposed at a luminance of 2.0 lux using a tungsten lamp of color temperature 2854° K. and the half reduction exposure at this time was 5.9 lux.sec.

Next, the sample was charged, in the dark, to a surface potential of about +400 V and then a contact imagewise exposure was made through a transparent original which had a positive image. The sample was then immersed in a liquid developer which contained a toner which had been prepared by adding 5 parts of finely divided, dispersed poly(methyl methacrylate) (toner) and 0.01 part of soy bean oil lecithin to 1000 parts of "Isoper H" (a petroleum based solvent, made by the Esso Standard Co.) and a clear positive toner image was obtained.

Moreover, the sample was heated to 100° C. for a period of 30 seconds to fix the toner image. This printing plate material was then immersed for about 1 minute in a solution obtained by dissolving 70 parts of hydrated sodium metasilicate in 140 parts of glycerine, 550 parts of ethylene glycol and 150 parts of ethanol and then washed with flowing water while brushing gently to provide a printing plate from which the electrophotographic photosensitive layer had been removed in the parts where no toner had been attached.

Furthermore, an electrostatic latent image obtained in this way was subjected to magnetic brush development using Xerox 3500 type toner (made by Fuji Xerox Co., Ltd.) instead of using the liquid developer and this was fixed by heating to 80° C. for 30 seconds. A printing plate was then obtained by removing the photosensitive layer from the parts to which no toner had been fixed using an alkaline solution.

The printing plates obtained in the ways described above were used on a "Hamada Star 600CD" offset printing machine and printing was carried out in the usual way, and it was possible to obtain 50,000 very clear prints with no base staining.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising an electrically conductive support having thereon a layer which contains a charge carrier transporting compound and a charge carrier generating compound, or a layer which contains charge carrier transporting compound and a layer which contains a charge generating compound, wherein at least one type of tris-azo compound represented by formula (I) is included as a charge carrier generating compound:

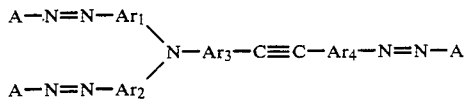

(I)

wherein $Ar_1$, $Ar_2$, $Ar_3$ and $Ar_4$, which may be the same or different, each is a divalent condensed polycyclic aromatic group or a divalent heterocyclic aromatic group, $Ar_1$ and $Ar_2$, $Ar_2$ and $Ar_3$, and $Ar_3$ and $Ar_1$ may, together with the nitrogen atom in formula (I) and a group of other atoms as required, form a ring;

A is one of the following groups,

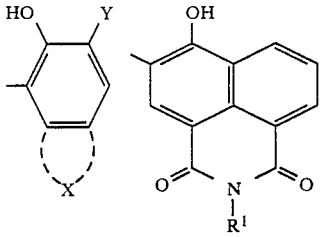

-continued

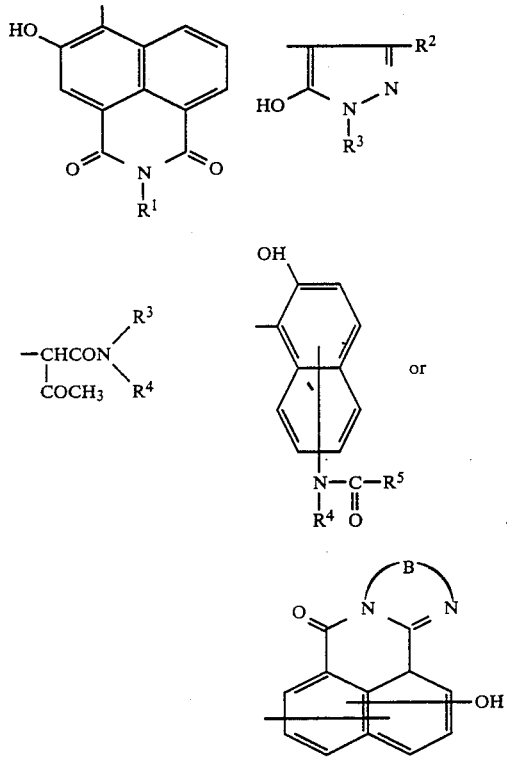

wherein X is a group of atoms which is required to complete an aromatic ring or a heterocyclic ring which is condensed with the benzene ring to which the hydroxyl group and the group Y are bonded in the above mentioned formula, Y represents

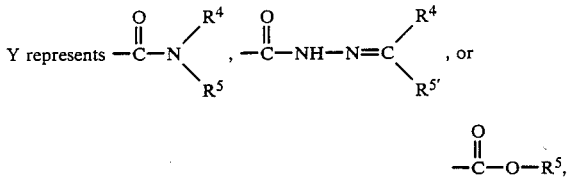

$R^1$ represents an alkyl group or a phenyl group;

$R^2$ is a hydrogen atom, a lower alkyl group, a carbamoyl group, a carboxyl group, an alkoxycarbonyl group, an aryloxycarbonyl group or an amino group;

$R^3$ is an alkyl group, an aromatic group or a heterocyclic aromatic group;

$R^4$ and $R^5$ each is a hydrogen atom, an alkyl group, an aromatic group or a heterocyclic aromatic group, provided that $R^4$ and $R^5$ cannot both be hydrogen atoms at the same time, further provided that $R^5$ may not be a hydrogen atom when Y is

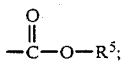

and

B represents a divalent aromatic hydrocarbyl group or a divalent heterocyclic ring in which a nitrogen is included.

2. An electrophotographic photoreceptor as in claim 1, wherein X together with the benzene ring to which a hydroxyl group and a Y group are bonded forms a ring selected from the group consisting of a naphthalene ring, an anthracene ring, an indole ring, a carbazole ring, a benzocarbazole ring or a dibenzofuran ring, which ring may be substituent groups selected from halogen atoms or lower alkyl groups having 1 to 8 carbon atoms.

3. An electrophotographic photoreceptor as in claim 1, where $R^1$ is an alkyl group having from 1 to 12 carbon atoms or a phenyl group, each of which may be substituted.

4. An electrophotographic photoreceptor as in claim 3, wherein the substituent groups in the case where $R^1$ is a substituted alkyl group are selected from the groups consisting of hydroxyl groups, alkoxy groups which have from 1 to 12 carbon atoms, cyano groups, amino groups, alkylamino groups which have from 1 to 12 carbon atoms, dialkylamino groups in which there are two alkyl groups which each has from 1 to 12 carbon atoms, halogen atoms and aryl groups which have from 6 to 15 carbon atoms, and wherein said substituent groups in the case where $R^1$ represents a substituted phenyl group are selected from the group consisting of hydroxyl groups, alkoxy groups which have from 1 to 12 carbon atoms, cyan groups, amino groups, alkylamino groups which have from 1 to 12 carbon atoms, dialkylamino groups in which there are two alkyl groups which have from 1 to 12 carbon atoms, halogen atoms, alkyl groups which have from 1 to 6 carbon atoms and nitro groups.

5. An electrophotographic photoreceptor as in claim 1, wherein $R^2$ is a hydrogen atom, a lower alkyl group which has from 1 to 6 carbon atoms, a carbamoyl group, a carboxyl group, an alkoxycarbonyl group of which the alkoxy group has from 1 to 12 carbon atoms, an aryloxycarbonyl group of which the aryloxy group has from 6 to 20 carbon atoms, or a substituted or unsubstituted amino group.

6. An electrophotographic photoreceptor as in claim 1, wherein $R^3$ is an alkyl group which has from 1 to 20 carbon atoms, an aromatic group, a heterocyclic aromatic group which contains oxygen, nitrogen, sulfur, or substituted derivatives of these groups wherein said substituent groups are selected from the group consisting of hydroxyl groups, cyano groups, nitro groups, halogen atoms, alkyl groups which have from 1 to 12 carbon atoms, alkoxy groups which have from 1 to 12 carbon atoms, amino groups, alkylamino groups which have from 1 to 12 carbon atoms, dialkylamino groups which have from 1 to 12 carbon atoms, arylamino groups which have from 6 to 12 carbon atoms, diarylamino groups in which there are two aryl groups which have from 6 to 15 carbon atoms, carboxyl groups, alkali metal carboxylate groups, alkali metal sulfonate groups, alkylcarbonyl groups, arylcarbonyl groups in which the aryl groups have from 6 to 12 carbon atoms, alkylthio groups which have from 1 to 12 carbon atoms and arylthio groups which have from 6 to 12 carbon atoms, each of which groups may have from 1 to 3 substituent groups.

7. An electrophotographic photoreceptor as in claim 1, wherein $Ar_1$, $Ar_2$, $Ar_3$ and $Ar_4$ are independently selected from the group consisting of phenylene, naphthalene, anthrylene, biphenylene, terphenylene, indene, fluorene, accenaphtene, perylene, fluorenone, anthrone, anthraquinone, benzanthrone, isocoumarin, pyridine, quinoline, oxazole, thiazole, oxadiazole, benzoxazole, benzimidazole, benzothiazole, benzotriazole, dibenzofuran, carbazole and xanthene.

8. An electrophotographic photoreceptor as in claim 1, wherein said tris-azo compound represented by formula (I), which may be dispersed in a charge carrier transporting medium are established on an electrically conductive support.

9. An electrophotographic photoreceptor as in claim 1, wherein said electrically conductive support has provided thereon a charge carrier generating layer and a charge carrier transporting layer, respectively, and wherein said charge carrier generating layer comprises said tris-azo compound of formula (I).

10. An electrophotographic photoreceptor as in claim 1, wherein said electrically conductive support has provided thereon a charge carrier transporting layer and a charge carrier generating layer, respectively, wherein said charge generating layer comprises said tris-azo compound.

11. An electrophotographic photoreceptor as in claim 8, wherein said tris-azo compound is dispersed in a solution obtained by dissolving a charge carrier transporting compound and a binder.

12. An electrophotographic photoreceptor as in claim 9, wherein said charge carrier generating layer further contains a binder.

13. An electrophotographic photoreceptor as in claim 10, wherein said charge carrier generating layer further contains a binder.

14. An electrophotographic photoreceptor as in claim 8, wherein the amount of tris-azo compound is from 0.01 to 0.5 times by weight the weight of charge carrier transporting compound.

15. An electrophotographic photoreceptor as in claim 11, wherein the amount of tris-azo compound is from 0.01 to 0.5 times by weight the weight of binder, and the amount of charge carrier transporting compound is from 0.1 to 2 times by weight the weight of binder.

16. An electrophotographic photoreceptor as in claim 12, the amount of tris-azo compound is from 0.1 to 20 by weight the weight of binder.

17. An electrophotographic photoreceptor as in claim 13, the amount of tris-azo compound is from 0.1 to 20 by weight the weight of binder.

* * * * *